US012227382B2

(12) United States Patent
Ao et al.

(10) Patent No.: US 12,227,382 B2
(45) Date of Patent: Feb. 18, 2025

(54) FEEDING DEVICE AND RECORDING DEVICE

(71) Applicant: SEIKO EPSON CORPORATION, Tokyo (JP)

(72) Inventors: Junko Ao, Shiojiri (JP); Katsuyuki Kondo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 213 days.

(21) Appl. No.: 18/155,540

(22) Filed: Jan. 17, 2023

(65) Prior Publication Data

US 2023/0227281 A1 Jul. 20, 2023

(30) Foreign Application Priority Data

Jan. 18, 2022 (JP) ..... 2022-005595

(51) Int. Cl.
*B65H 3/06* (2006.01)
*B65H 1/08* (2006.01)
*B65H 3/56* (2006.01)

(52) U.S. Cl.
CPC ..... *B65H 3/06* (2013.01); *B65H 1/08* (2013.01); *B65H 3/56* (2013.01); *B65H 2404/165* (2013.01)

(58) Field of Classification Search
CPC ..... B65H 1/04; B65H 1/08; B65H 1/14; B65H 1/266; B65H 3/06; B65H 3/56; B65H 3/68; B65H 3/5215; B65H 2404/165; B65H 2402/60; B65H 2405/11152; B65H 2405/11161; B65H 2405/1136; B65H 2405/324; B65H 2407/21; B65H 2601/324; B65H 2801/06; B65H 2701/1131; B65H 5/062
See application file for complete search history.

(56) References Cited

U.S. PATENT DOCUMENTS

| | | | | |
|---|---|---|---|---|
| 10,968,061 | B2 * | 4/2021 | Aoyama | B65H 1/266 |
| 11,760,593 | B2 * | 9/2023 | Yamamoto | B65H 3/68 271/109 |
| 2009/0079125 | A1 | 3/2009 | Yuasa | |
| 2022/0281701 | A1 * | 9/2022 | Yamamoto | B65H 3/0676 |

FOREIGN PATENT DOCUMENTS

JP 2009-078887 A 4/2009

* cited by examiner

*Primary Examiner* — Leslie A Nicholson, III
(74) *Attorney, Agent, or Firm* — WORKMAN NYDEGGER

(57) ABSTRACT

A feeding unit includes a paper feeding tray, a lifter, a feeding roller, a guide plate, and a handling portion. The lifter can displace paper in the paper feeding tray in a +B direction. The guide plate guides a downstream end of the paper lifted by the lifter in a +A direction toward the feeding roller. The handling portion handles the paper toward the feeding roller. The guide plate forms a frontage through which the paper can pass between the guide plate and an outer peripheral surface of the feeding roller, and is provided so that a size of the frontage can be adjusted. The handling portion is provided integrally with the guide plate.

10 Claims, 22 Drawing Sheets

FEEDING DEVICE AND RECORDING DEVICE

The present application is based on, and claims priority from JP Application Serial Number 2022-005595, filed Jan. 18, 2022, the disclosure of which is hereby incorporated by reference herein in its entirety.

BACKGROUND

1. Technical Field

The present disclosure relates to a feeding device and a recording device.

2. Related Art

The paper feeding device disclosed in JP-A-2009-78887 has a primary separating portion upstream to a transport roller. A friction member is attached to the primary separating portion. The tip end portions of the plurality of media are handled along the inclined surface of the friction member by the frictional force and inclination of the friction member.

The paper feeding device disclosed in JP-A-2009-78887 is configured such that the position of the friction member is not adjusted with respect to the position of the transport roller. Therefore, when the thickness or the number of media to be transported is changed, the load applied to the media between the transport roller and the friction member fluctuates, so that there is a problem in that an action of handling the media is lowered.

SUMMARY

According to an aspect of the present disclosure, there is provided a feeding device including a medium stacking portion that stacks a medium; an elevating portion that is configured to displace the medium of the medium stacking portion in a stacking direction; a rotating member that feeds the medium lifted by the elevating portion in a feeding direction; a guide portion that guides a downstream end in the feeding direction of the medium lifted by the elevating portion toward the rotating member; and a handling portion that handles the medium toward the rotating member, wherein the guide portion forms a frontage through which the medium is configured to pass between the guide portion and an outer peripheral surface of the rotating member, and is provided such that a size of the frontage is configured to be adjusted, and the handling portion is provided integrally with the guide portion.

According to another aspect of the present disclosure, there is provided to a recording device including the feeding device according to any one of a first to ninth aspects, and a recording portion that records on the medium fed from the feeding device.

DESCRIPTION OF EXEMPLARY EMBODIMENTS

Figure 1:
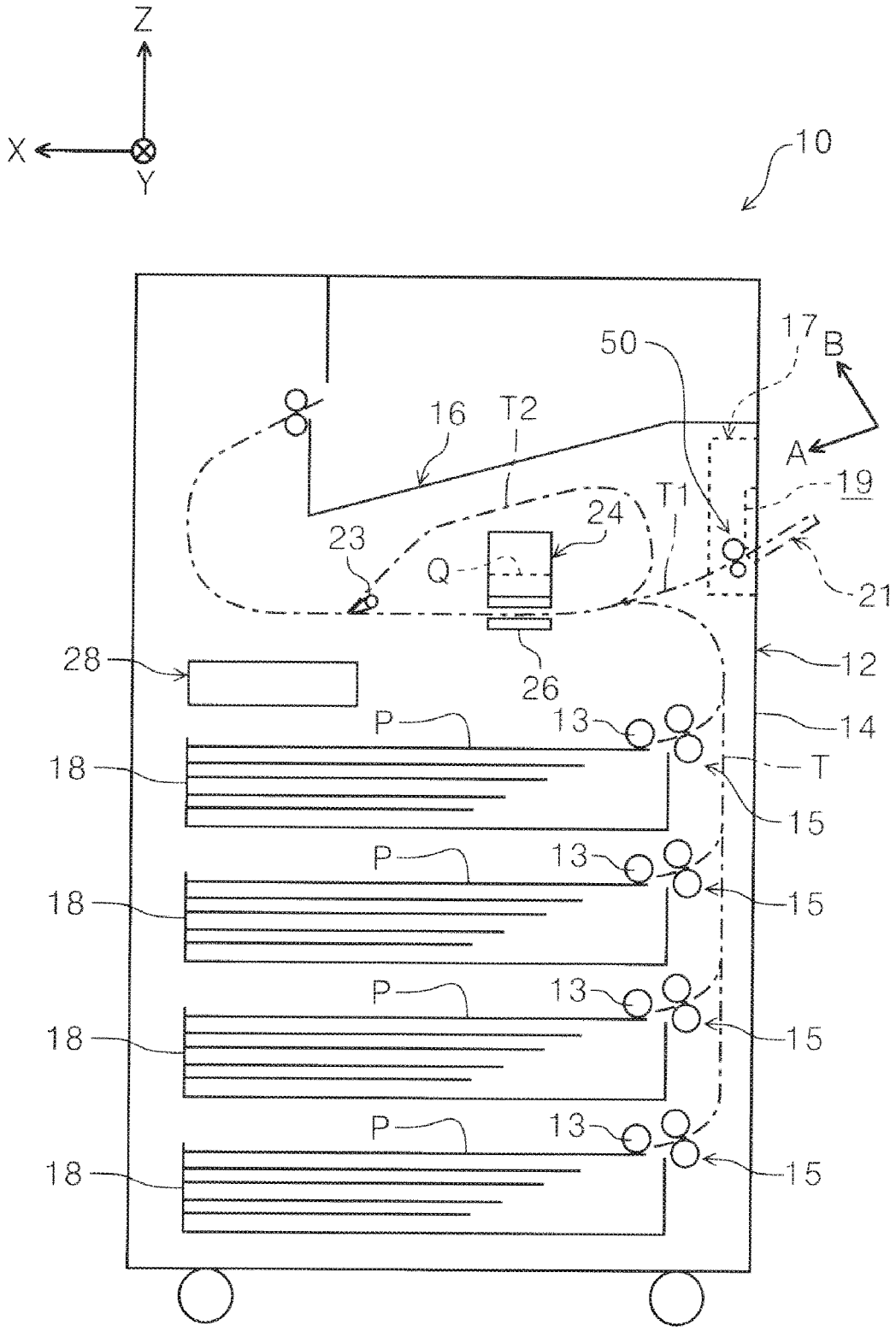
FIG. 1 is an overall configuration diagram of a feeding unit and a printer according to a first embodiment.

Hereinafter, the present disclosure will be schematically described.

According to a first aspect of the present disclosure, a feeding device includes a medium stacking portion that stacks a medium; an elevating portion that is configured to displace the medium of the medium stacking portion in a stacking direction; a rotating member that feeds the medium lifted by the elevating portion in a feeding direction; a guide portion that guides a downstream end in the feeding direction of the medium lifted by the elevating portion toward the rotating member; and a handling portion that handles the medium toward the rotating member, wherein the guide portion forms a frontage through which the medium is configured to pass between the guide portion and an outer peripheral surface of the rotating member, and is provided such that a size of the frontage is configured to be adjusted, and the handling portion is provided integrally with the guide portion.

According to the present aspect, since the handling portion is provided integrally with the guide portion, the handling portion and the guide portion are suppressed from being misaligned, as compared to a configuration in which the handling portion is provided separately from the guide portion.

Here, since the size of the frontage is adjusted by changing the position of the guide portion with respect to the rotating member, the number of sheets of the medium supplied to the rotating member through the frontage can be limited within a predetermined number of sheets.

Furthermore, when the size of the frontage is adjusted, the handling portion is provided integrally with the guide portion. Therefore, not only the position of the guide portion with respect to the rotating member but also the position of the handling portion with respect to the rotating member can be adjusted. That is, the interval between the rotating member and the handling portion is also adjusted according to the adjustment of the size of the frontage. As a result, a predetermined load is applied to the medium sandwiched between the rotating member and the handling portion, so that it is possible to suppress the deterioration of the action of handling the medium by the handling portion.

A second aspect of the present disclosure provides the feeding device according to the first aspect, in which a plurality of the handling portions are provided at an interval in a width direction of the medium which intersects the feeding direction, and when viewed from the feeding direction, one handling portion of the handling portions is positioned on one side of the rotating member with respect to a center of the width direction, and the other handling portion is positioned on the other side of the rotating member with respect to the center of the width direction.

According to the present aspect, in the medium fed toward the rotating member, the one handling portion comes into contact with one side of the center in the width direction, and the other handling portion comes into contact with the other side. As a result, it is possible to suppress the medium from skewing in the feeding direction as compared with a configuration in which the handling portion comes into contact with only one portion of the medium.

A third aspect of the present disclosure provides the feeding device according to the second aspect, in which, when viewed from the feeding direction, the plurality of handling portions are positioned outside the rotating member in the width direction with respect to the outer peripheral surface.

According to the present aspect, since the rotating member and the handling portion do not come into contact with the same position of the medium in the width direction, it is possible to suppress a part of the medium from being more easily worn compared with other parts.

A fourth aspect of the present disclosure provides the feeding device according to the second aspect or the third aspect, in which a size of the interval between the one handling portion and the other handling portion in the width direction is smaller than a size of the medium having a smallest size in the width direction among the fed media.

According to the present aspect, the media of all sizes that can be fed by the feeding device can be handled by the handling portion.

A fifth aspect of the present disclosure provides the feeding device according to any one of the first to fourth aspect, which further includes a retard roller that forms a nip portion by coming into contact with the outer peripheral surface, wherein using a tangent line of the outer peripheral surface, which passes through a virtual point at a center of the nip portion in the feeding direction as a reference line, a handling surface of the handling portion which comes into contact with the medium extends along the reference line.

According to the present aspect, the nip portion is formed by the rotating member and the retard roller. Therefore, the position of the medium whose downstream end first comes into contact with the outer peripheral surface and the position of the virtual point are shifted in the circumferential direction of the outer peripheral surface. As a result, since the directions of the tangent lines at the respective positions are different, the medium that advances along with the rotation of the rotating member changes a traveling direction by coming into contact with the handling portion, thereby advancing toward the nip portion.

Here, the handling surface of the handling portion extends along the reference line. Therefore, as compared with a configuration in which the handling surface along a direction different from a direction of the reference line, a chance of contact of the handling portion with the medium increases and the medium is easily guided to the nip portion. As a result, the handling portion can enhance the effect of handling the medium advancing toward the nip portion.

A sixth aspect of the present disclosure provides the feeding device according to the fifth aspect, which further includes a holder portion that rotatably holds the retard roller; and an accommodating portion that accommodates the holder portion, in which the holder portion is detachably provided in the accommodating portion.

According to the present aspect, the retard roller can be replaced by removing the holder portion from the accommodating portion.

A seventh aspect of the present disclosure provides the feeding device according to the sixth aspect, in which the guide portion is provided in the holder portion.

According to the present aspect, the retard roller and the guide portion are provided in the holder portion. Therefore, as compared with a configuration in which the guide portion is provided on a member different from the holder portion, the positional accuracy of the guide portion with respect to the retard roller can be improved.

An eighth aspect of the present disclosure provides the feeding device according to any one of the first to seventh aspect, which further includes an outer handling portion that handles the medium toward the rotating member on an outside with respect to the handling portion in a width direction of the medium, which intersects the feeding direction, wherein an outer handling surface of the outer handling portion which comes into contact with the medium is positioned above a handling surface of the handling portion which comes into contact with the medium in a vertical direction.

Based on the same principle as a cantilever beam, the medium to be fed is easily hung downward in the vertical direction as the distance from the center in the width direction increases.

According to the present aspect, the outer handling surface positioned outside in the width direction is positioned above the handling surface in the vertical direction. As a result, even when both end portions of the medium in the width direction are hung down, both the end portions of the medium are lifted upward and handled by the outer handling surface, so that both the end portions of the medium in the width direction can be easily handled.

A ninth aspect of the present disclosure provides the feeding device according to any one of the first to eighth aspects, in which the handling portion has a plurality of handling surfaces aligned in the feeding direction and coming into contact with the medium.

According to the present aspect, the plurality of handling surfaces are included and the chance of contact between the medium and the handling portion increases, so that the handling performance of the medium can be enhanced by the handling portion.

According to a tenth aspect of the present disclosure provides a recording device including the feeding device according to any one of the first to ninth aspect; and a recording portion that records on the medium fed from the feeding device.

According to the present aspect, it is possible to obtain the same actions and effects as any one of the first to ninth aspects.

First Embodiment

Hereinafter, a printer 10 and a feeding unit 50 will be specifically described as a first embodiment, which is an example of a recording device and a feeding device according to the present disclosure.

The printer 10 is shown in FIG. 1. The printer 10 is an example of a recording device that performs recording by ejecting ink Q, which is an example of s liquid, onto paper P, which is an example of a medium. Specifically, the printer 10 includes the feeding unit 50 that is an example of a feeding device, and a recording head 24 that is an example of a recording portion that records on the paper P that is fed from the feeding unit 50.

An XYZ coordinate system shown in each drawing is a rectangular coordinate system.

An X direction is a device width direction of the printer 10 viewed from a user and is a horizontal direction. In the X direction, a direction toward the left is a +X direction, and a direction toward the right is a −X direction.

A Y direction is a width direction of the paper P, which intersects a feeding direction of the paper P, and a device depth direction, and is the horizontal direction. In the Y direction, a direction toward the front is a −Y direction, and a direction toward the back is a +Y direction.

A Z direction is a device height direction, and is, for example, a vertical direction. In the Z direction, an upward direction is a +Z direction, and a downward direction is a −Z direction. The +Z direction is an example of a retreat direction. The −Z direction is an example of an opposite direction.

In a paper feeding tray 21, which will be described later, a direction in which the paper P is fed is a +A direction. That is, the +A direction is an example of the feeding direction. A direction opposite to the +A direction is a −A direction. The A direction intersects with the X direction, the Y direction, and the Z direction.

Further, in the paper feeding tray 21, a direction in which the paper P is stacked is a +B direction. That is, the +B direction is an example of a stacking direction, and is a direction which intersects the A, X, Y, and Z directions. A direction opposite to the +B direction is a −B direction.

The printer 10 has a main body portion 12. Inside the main body portion 12, the paper P is transported through a transporting path T indicated by a dashed line. The main body portion 12 has a housing 14 that forms an outer shell of the printer 10. A side portion of the housing 14 in the −X direction has a door portion 17 which stands upright along the Z direction.

The door portion 17 is formed with an opening portion 19 that opens in the −X direction. Further, the door portion 17 is provided with a paper feeding tray 21 capable of opening and closing the opening portion 19. The paper feeding tray 21 will be described later.

In the +Z direction from the center of the housing 14 in the Z direction, a discharge portion 16 for discharging the recorded paper P is formed. Further, a plurality of cassettes 18 are provided in the housing 14. The paper P is accommodated in the plurality of cassettes 18. The paper P accommodated in each cassette 18 is transported along the transporting path T by a pick roller 13 and a transport roller pair 15.

The transporting path T merges with a feeding path T1. The feeding path T1 is a path through which the paper P is fed from the paper feeding tray 21 by the feeding unit 50, which will be described later. The supplying of the paper P toward the transporting path T by the feeding unit 50 is referred to as "feeding" and is distinguished from "transport" of the paper P in other paths.

Further, the transporting path T is coupled to a reversing path T2 for reversing the front and back of the paper P. Further, the transporting path T is disposed with a plurality of transport roller pairs (not shown) that transport the paper P, a flap 23 that switches the transporting path, and a sensor (not shown) that detects the width of the paper P in the Y direction.

Further, the transporting path T is disposed with the recording head 24 described above and a support base 26 that supports the paper P at a position facing the recording head 24.

The main body portion 12 has a control portion 28.

The control portion 28 includes a Central Processing Unit (CPU), a Read Only Memory (ROM), a Random Access Memory (RAM), and a storage (which are not shown), and controls transport of the paper P in the printer 10 or an operation of each portion including the recording head 24.

Figure 2:
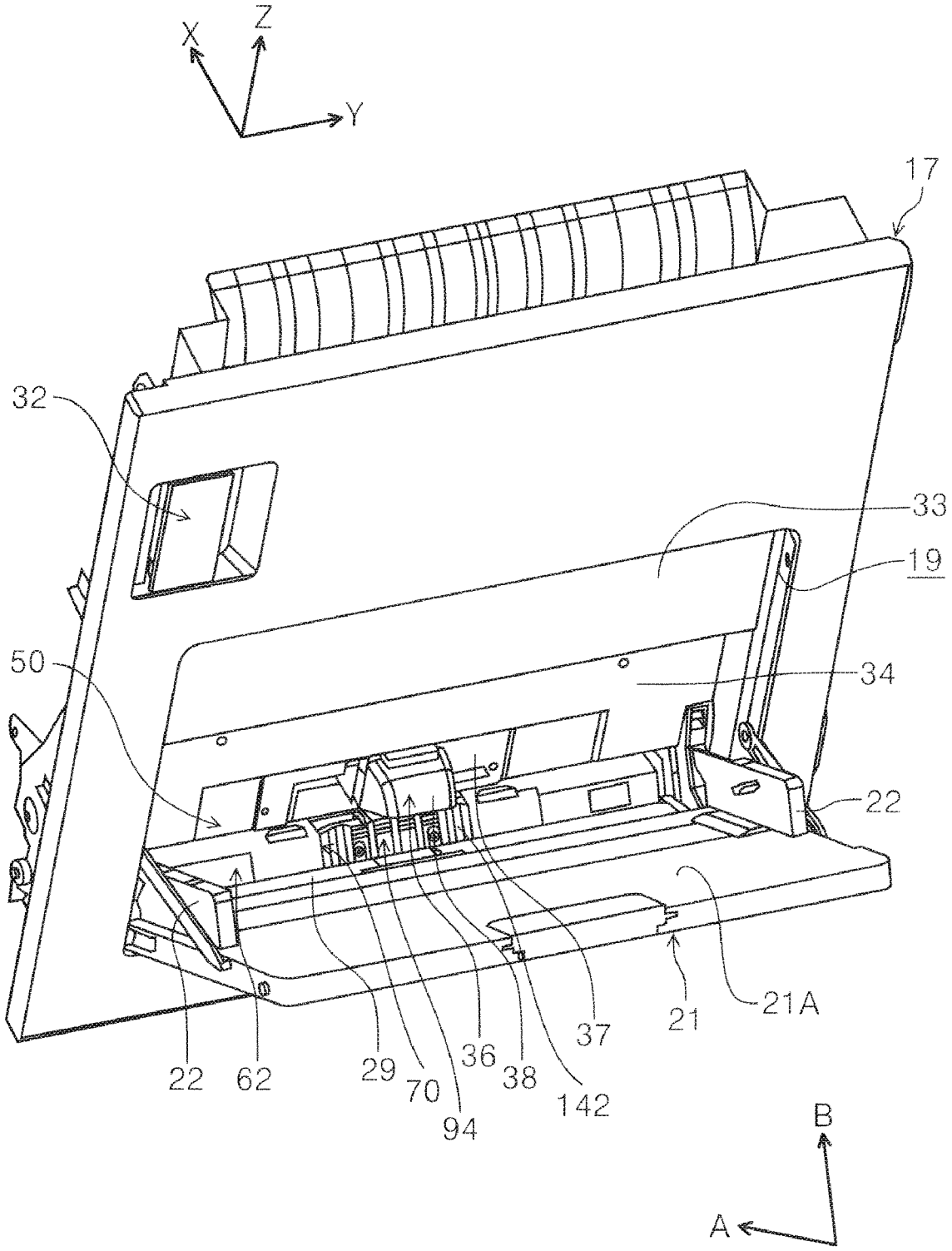
FIG. 2 is a perspective view showing an open state of a paper feeding tray of the feeding unit according to the first embodiment.

As shown in FIG. 2, the door portion 17 is configured as an opening/closing member that opens and closes a part of the housing 14 (FIG. 1). An end portion of the door portion 17 in the +Y direction is rotatably supported with respect to the housing 14 by a hinge portion (not shown). A locking portion 32 is provided at an end portion of the door portion 17 in the −Y direction. The locking portion 32 locks or unlocks the door portion 17 to or from the housing 14. In this manner, the door portion 17 is opened and closed in a lateral direction.

An upper wall 33 and a lower wall 34 are provided inside the opening portion 19 of the door portion 17.

The upper wall 33 contacts an end portion of the paper feeding tray 21, which stands upright, in the +Z direction.

The lower wall 34 is provided at a position in the −Z direction and +X direction with respect to the upper wall 33. Further, a roller cover 36 is provided on the lower wall 34. A base guide 62, which will be described later, is provided in the −Z direction with respect to the lower wall 34.

The roller cover 36 is an example of a cover member that covers a feeding roller 46 (FIG. 3), which will be described later. Further, the roller cover 36 has a plate mounting portion 37 and a grip portion 38 protruding from the mounting portion 37 in the −X direction. When screws (not shown) are removed, the roller cover 36 can be detached from the door portion 17.

In a state in which the roller cover 36 is attached to the door portion 17, the roller cover 36 covers a feeding roller 46 (FIG. 3), a knob 112 (FIG. 10), and an operating portion 164 (FIG. 6), which will be described later, in the +Z direction and the −X direction. On the other hand, in a state in which the roller cover 36 is removed from the door portion 17, the feeding roller 46, the knob 112, and the operating portion 164 are exposed in the +Z direction and the −X direction.

Next, the feeding unit 50 is described.

Figure 3:
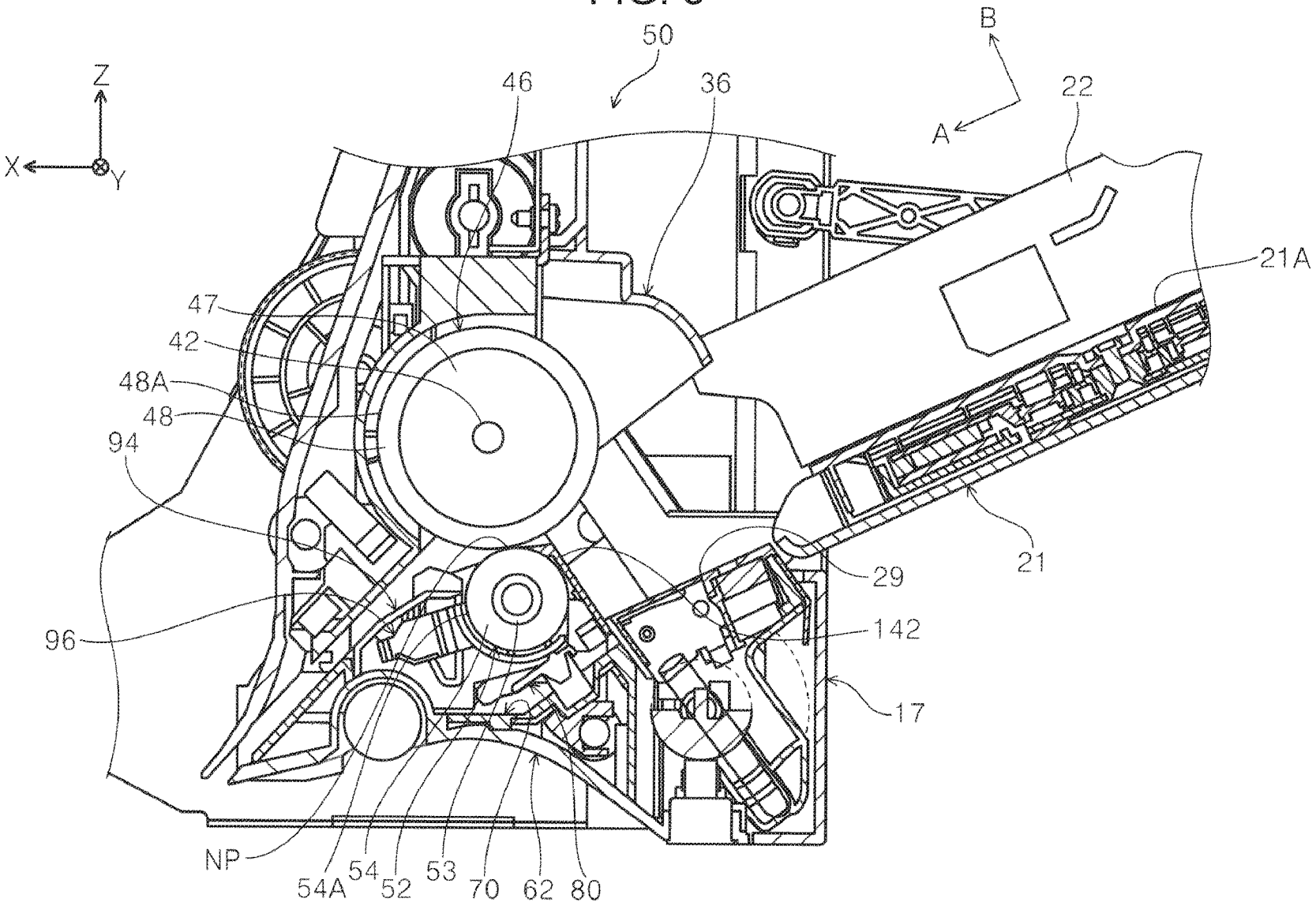
FIG. 3 is a diagram showing the open state of the paper feeding tray of the feeding unit according to the first embodiment.
Figure 4:
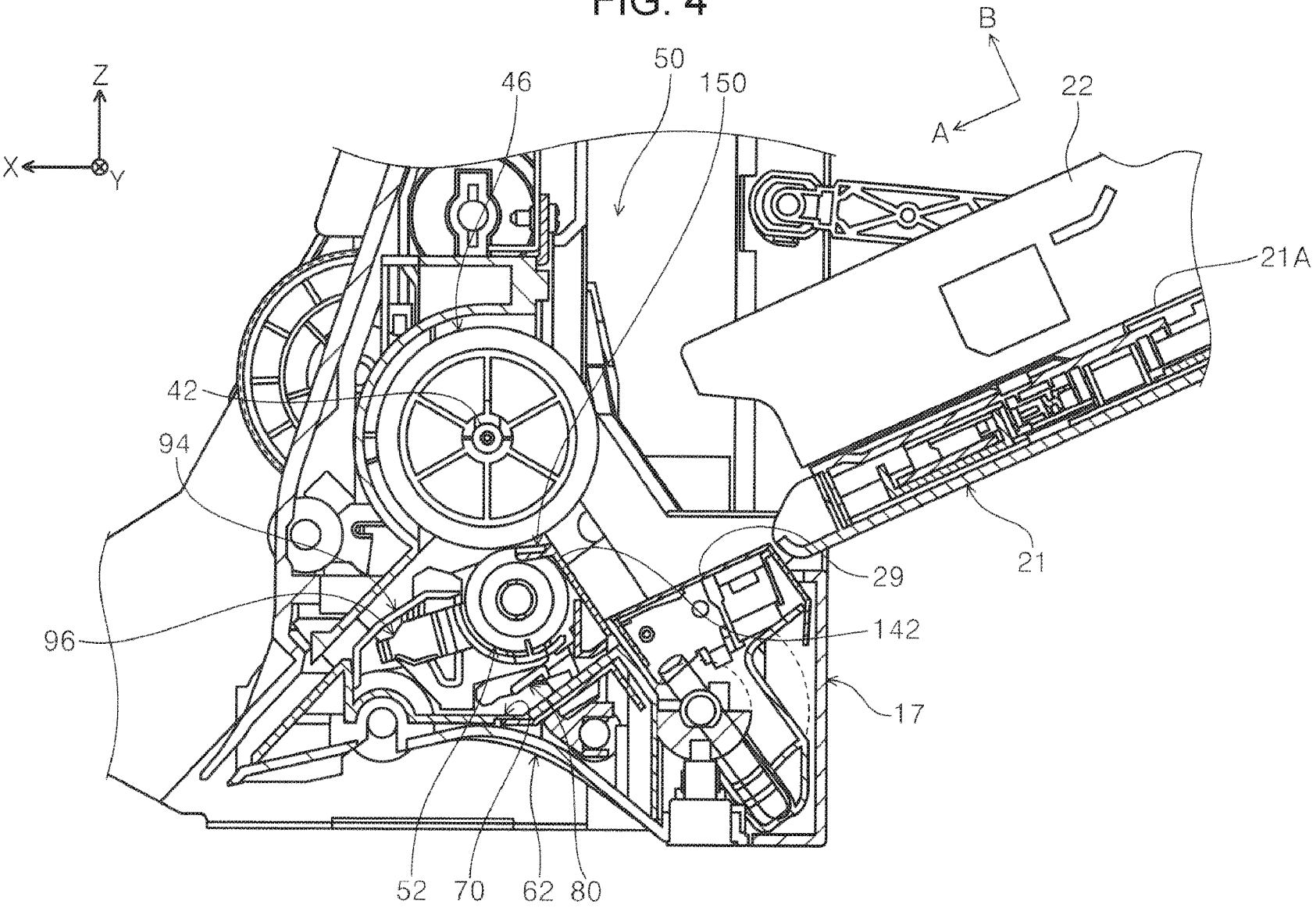
FIG. 4 is a view showing a positional configuration in a different width direction from FIG. 3 in the open state of the paper feeding tray of the feeding unit according to the first embodiment.
Figure 6:
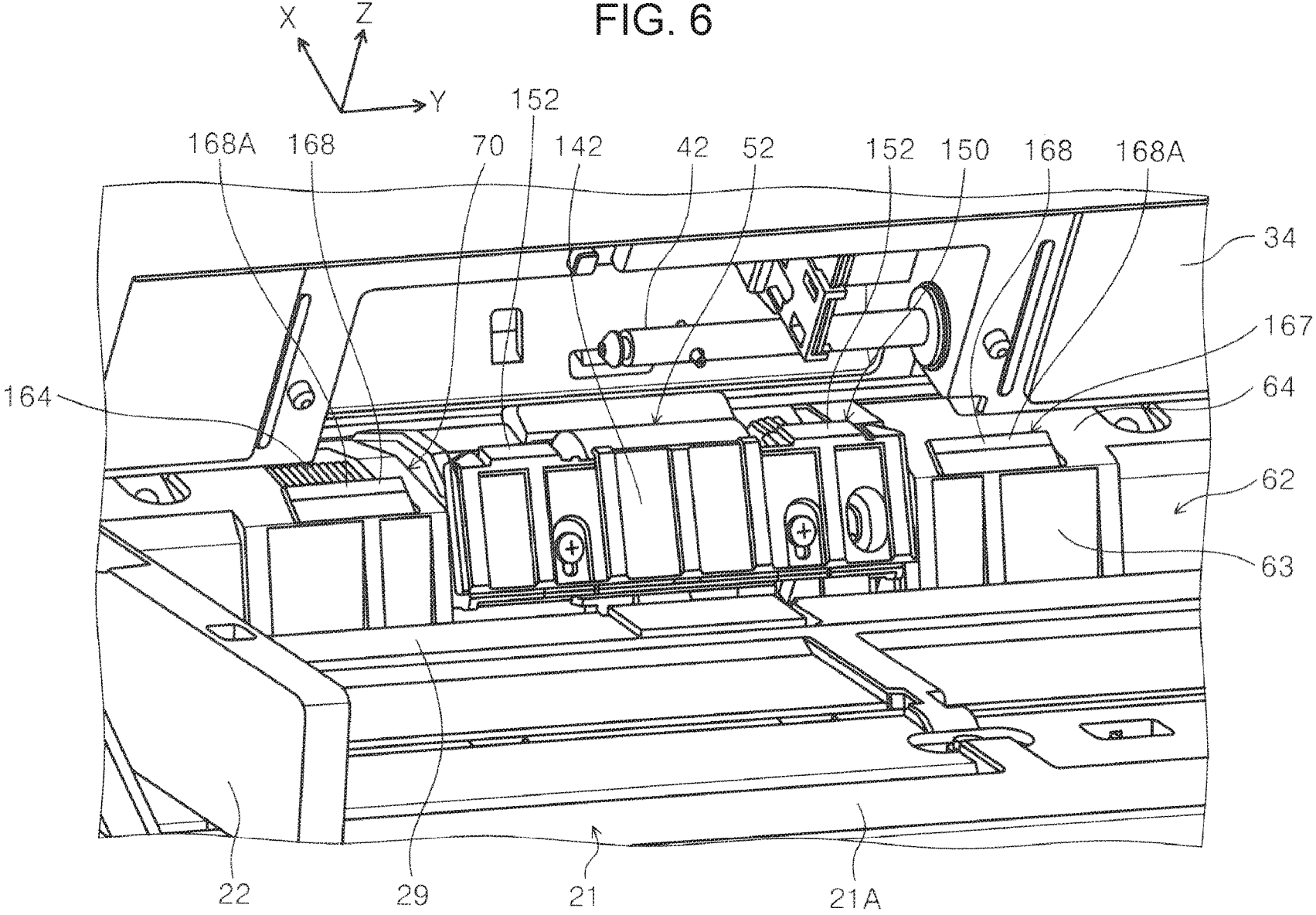
FIG. 6 is a perspective view showing a state in which a feeding roller is removed from the feeding unit according to the first embodiment.

As shown in FIGS. 2, 3, and 4, the feeding unit 50 includes the paper feeding tray 21, a lifter 29, the feeding roller 46, a retard roller 52, the base guide 62, the accommodating portion 70, a first pressing portion 80, a holder portion 94, and a guide plate 142. Further, the feeding unit 50 includes a handling portion 150 (FIG. 4), a second pressing portion 156 (FIG. 7), a release lever 162 (FIG. 16), a second restricting portion 182 (FIG. 7), and an outer handling portion. 167 (FIG. 6).

As shown in FIG. 2, the paper feeding tray 21 is an example of a medium stacking portion on which the paper P is stacked. The paper feeding tray 21 is rotatably supported with the Y direction as an axial direction by a hinge portion (not shown) provided at an edge portion of the opening portion 19 in the −Z direction. The paper feeding tray 21 closes the opening portion 19 along the Z direction in a state of standing upright. The paper feeding tray 21 opens the opening portion 19 in a tilted state in which the end portion in the −X direction is positioned in the +Z direction from the end portion in the +X direction.

Further, the paper feeding tray 21 is formed in a plate shape. The paper feeding tray 21 has a placement surface 21A on which the paper P is placed. A side guide 22 is provided on the placement surface 21A. The side guides 22 align both ends of the plurality of paper P stacked on the placement surface 21A in the Y direction.

The lifter 29 is provided between the side guide 22 and the base guide 62 which will be described later. The lifter 29 is an example of an elevating portion capable of displacing the paper P in the paper feeding tray 21 in the +B direction. As an example, the lifter 29 includes a motor and a cam (not shown). Specifically, the lifter 29 lifts a downstream end portion of the paper P in the +A direction, which is stacked on the placement surface 21A, in the +B direction.

As shown in FIG. 3, a drive shaft 42 and the feeding roller 46 are provided at a part of the door portion 17 facing the paper feeding tray 21 in the X direction.

The drive shaft 42 extends with the Y direction as the axial direction. The drive shaft 42 is rotatably supported by the door portion 17. Further, the drive shaft 42 is rotated by a motor and a gear (not shown).

The feeding roller 46 is an example of a rotating member that feeds the paper P lifted in the +B direction by the lifter 29 in the +A direction. The feeding roller 46 has a cylindrical roller body 47 and an elastic portion 48 that covers the outer periphery of the roller body 47. An outer peripheral surface 48A of the elastic portion 48 is an example of the outer peripheral surface of the feeding roller 46.

Further, the feeding roller 46 is disposed with the Y direction as the axial direction. When the feeding roller 46 is attached to the drive shaft 42, rotation accompanying rotation of the drive shaft 42 is possible. The feeding roller 46 is provided detachably with respect to the drive shaft 42.

The retard roller 52 is positioned in the −Z direction with respect to the feeding roller 46 and is rotatably provided with the Y direction as the axial direction. The retard roller 52 is rotated by coming into contact with the feeding roller 46. The retard roller 52 forms a nip portion NP by coming into contact with the outer peripheral surface 48A. The nip portion NP is a part where the paper P is sandwiched between the feeding roller 46 and the retard roller 52.

The retard roller 52 is an example of a separating member that separates the paper P.

Figure 8:
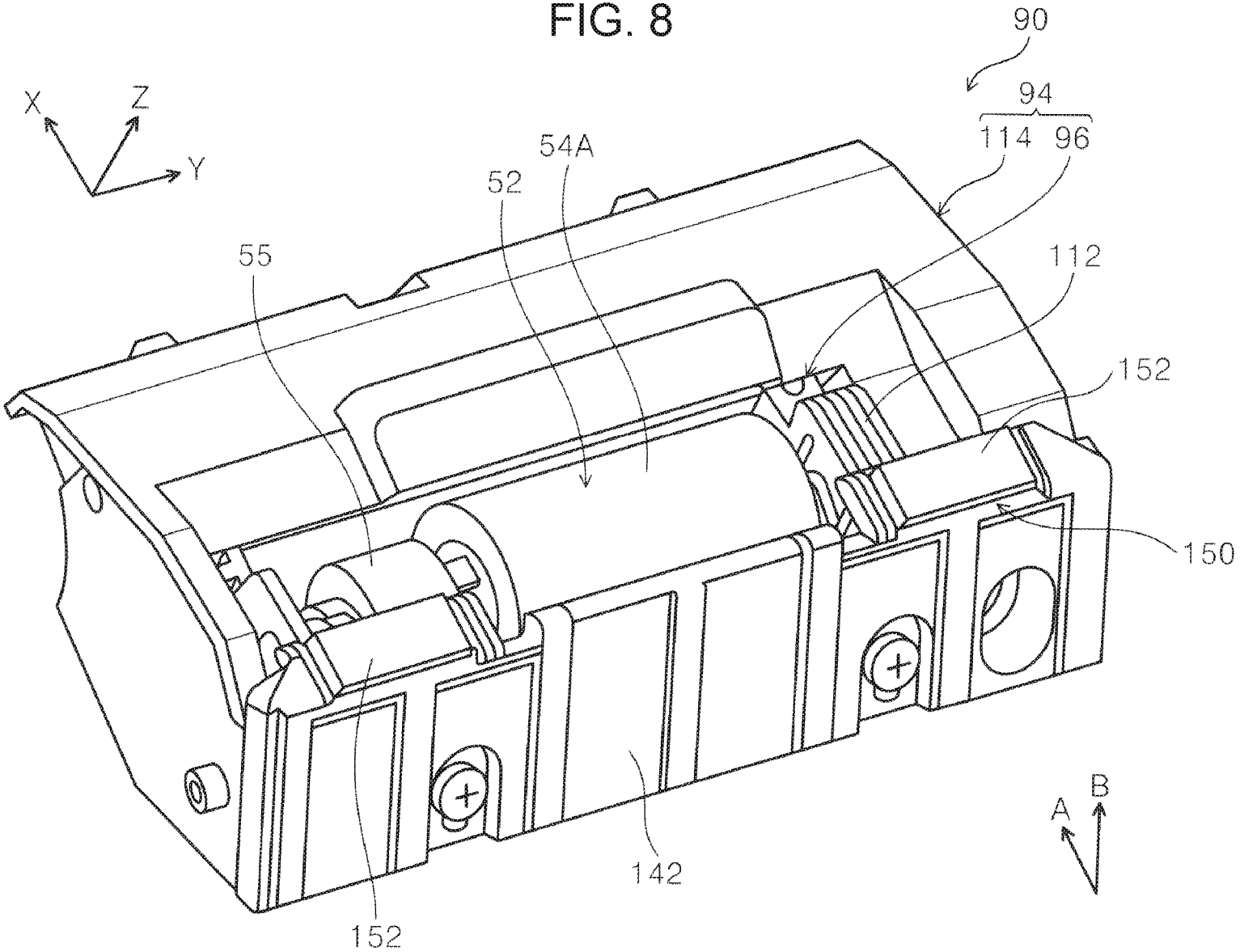
FIG. 8 is a perspective view showing the detachable unit of the feeding unit according to the first embodiment.

The retard roller 52 has a shaft portion 53 extending along the Y direction and a cylindrical elastic portion 54 covering the shaft portion 53. An outer peripheral surface 54A of the elastic portion 54 is in contact with the outer peripheral surface 48A in a state in which the paper P is not present. The rotating direction of the retard roller 52 and the rotating direction of the feeding roller 46 are opposite when viewed from the Y direction. As a result, one of the plurality of sheets of paper P is fed in the +A direction, and the rest of the sheets of paper P remain by being separated. The outer diameter of the retard roller 52 is smaller than the outer diameter of the feeding roller 46. A part of the shaft portion 53 is provided with a torque limiter 55 (FIG. 8).

Figure 5:
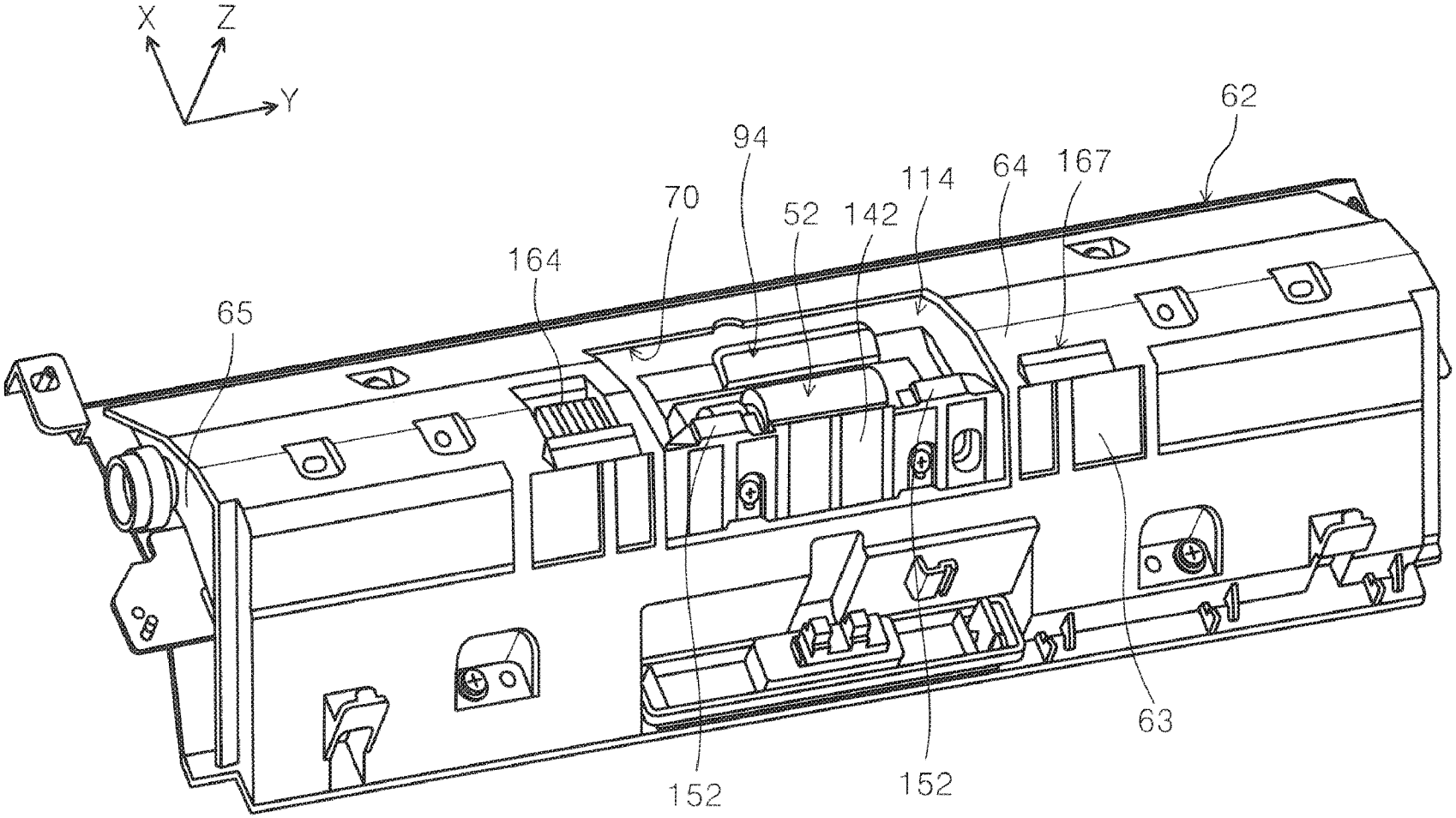
FIG. 5 is a perspective view showing a base guide and a detachable unit of the feeding unit according to the first embodiment.

As shown in FIGS. 5 and 6, the base guide 62 is, for example, made of resin, and is formed in a columnar shape extending in the Y direction. Further, the base guide 62 is disposed in the −Z direction with respect to the feeding path T1 (FIG. 1). Specifically, the base guide 62 includes a front wall portion 63 that is disposed to face the paper feeding tray 21, an upper wall portion 64 that extends from the end portion of the front wall portion 63 in the +Z direction along the feeding path T1, side wall portions 65 that are positioned at both ends in the Y direction, and an accommodating portion 70 that will be described later.

The accommodating portion 70 is formed across a central portion of the front wall portion 63 in the Y direction and a central portion of the upper wall portion 64 in the Y direction. Specifically, the accommodating portion 70 is formed as a recessed portion that is open in the +Z direction.

Figure 7:
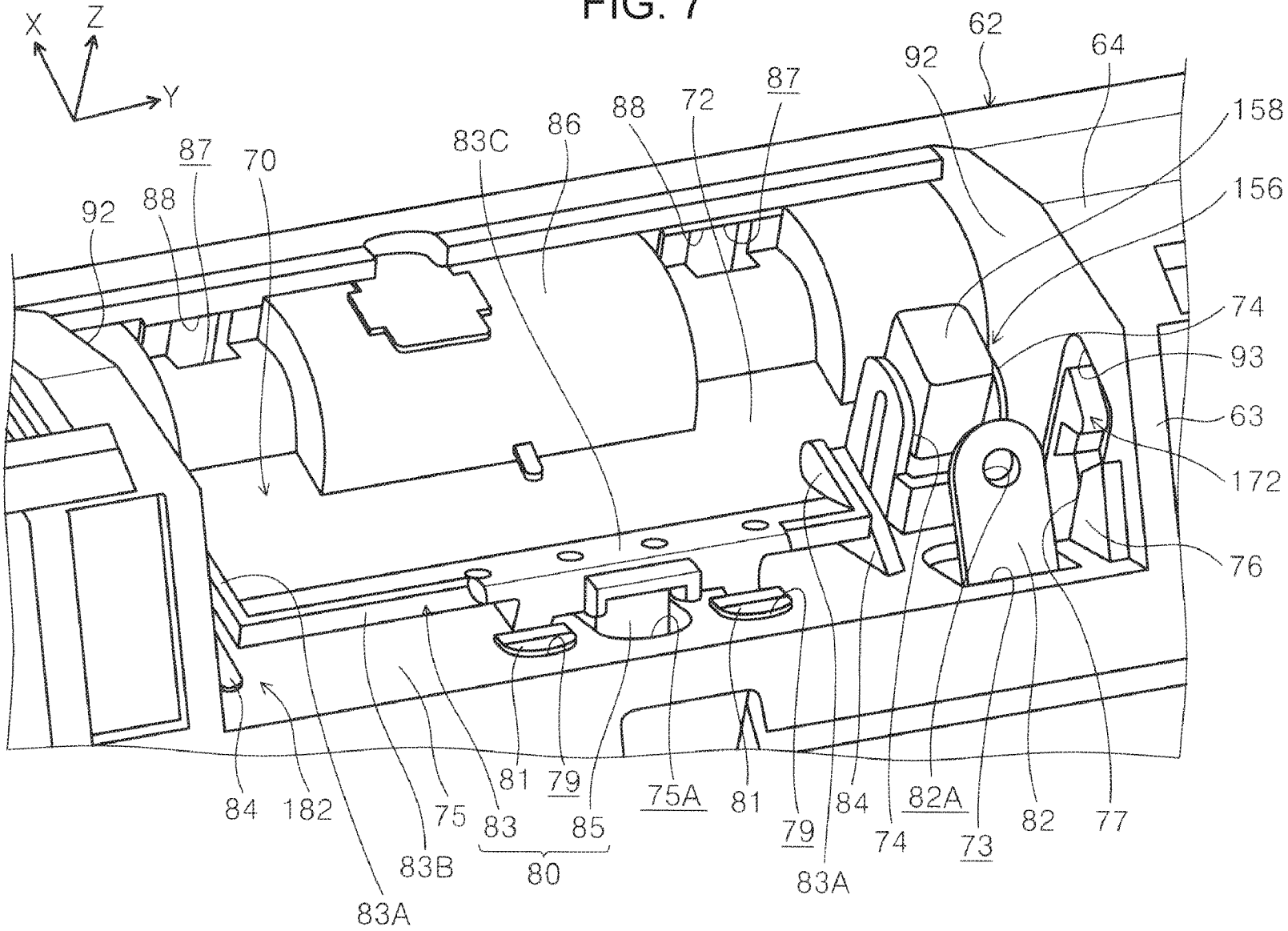
FIG. 7 is a partially enlarged perspective view showing a state in which the detachable unit is removed from the base guide of the feeding unit according to the first embodiment.

As shown in FIG. 7, the accommodating portion 70 includes, as an example, a recessed portion surrounded by a bottom wall 72, a front wall 75, a rear wall 86, and two inner side walls 92. Further, the accommodating portion 70 also has an edge portion 88, which will be described later, and accommodates the holder portion 94 (FIG. 5). In other words, the accommodating portion 70 accommodates the second holder 114 (FIG. 5). Further, the accommodating portion 70 is provided with a first pressing portion 80 which will be described later.

The bottom wall 72 is disposed substantially along an X-Y plane. A through hole 73 is formed at the end portion of the bottom wall 72 in the +Y direction. Two guide walls 74 are provided at the edge portion of the through hole 73 at an interval in the Y direction. The two guide walls 74 stand upright from the bottom wall 72 in the +Z direction.

The front wall 75 extends obliquely upward to intersect the X direction from the end portion of the bottom wall 72 in the −X direction. Two vertical wall portions 76 are provided at both end portions of the front wall 75 in the Y direction. FIG. 7 does not show the vertical wall portions 76 (FIG. 17) in the −Y direction.

The two vertical wall portions 76 protrude from the front wall 75 in the +X direction and the +Z direction. The height of the two vertical wall portions 76 is lower than the height of the inner side wall 92 which will be described later. Contact surfaces 77 are formed at the end portions of the two vertical wall portions 76 in the +X direction. An upper surface 78 (FIG. 17) is formed at the end portion of the vertical wall portion 76 in the +Z direction.

The contact surface 77 is, for example, a plane along the Y-Z plane. Further, the contact surface 77 is a surface disposed to be able to come into contact with a dowel 119 and a dowel 128 (FIG. 9), which will be described later. In other words, the contact surface 77 is a surface that guides the dowel 119 and the dowel 128 in the Z direction, and a surface that restricts the dowel 119 and the dowel 128 from being misaligned in the −X direction.

The upper surface 78 (FIG. 17) is an inclined surface for swinging the release lever 162 (FIG. 16) by pushing the dowel 119 and the dowel 128 when the second holder 114 is attached to the accommodating portion 70, and also serves to hold the dowel 119 and the dowel 128 when the second holder 114 detached.

In this manner, the accommodating portion 70 is provided with the vertical wall portion 76 that guides the dowel 119 and the dowel 128 in the Z direction.

A circular through hole 75A is formed at the central portion of the front wall 75 in the Y direction. Further, insertion holes 79 are respectively formed at parts of the front wall 75 in the +Y direction and the −Y direction with respect to the through hole 75A. A prismatic stopper portion 81 extending in the Y direction is provided at the edge portion of each insertion hole 79.

A mounting plate 82 is provided in the accommodating portion 70. The mounting plate 82 protrudes from the through hole 73 in the +Z direction and is fixed to the accommodating portion 70. The mounting plate 82 is formed with a mounting hole 82A which is a screw hole. A screw (not shown) can be fastened to the mounting hole 82A. The mounting plate 82 can be used to fix the guide plate 142 after the position of the guide plate 142 (FIG. 5), which will be described later, is adjusted.

Two ribs 84 are provided on the bottom wall 72 and the front wall 75. The two ribs 84 are disposed at an interval in the Y direction. In the two ribs 84, coupling holes (not shown) are formed to penetrate the ribs 84 in the Y direction.

Two through holes 87 are formed in the rear wall 86 at an interval in the Y direction. The edge portion 88 of the through hole 87 is a part where a protruding portion 132 (FIG. 9), which will be described later, is held.

The inner side wall 92 stands upright in the Z direction from both respective end portions of the bottom wall 72, the front wall 75, and the rear wall 86 in the Y direction. Further, the inner side wall 92 is arranged along the X-Z plane. The inner side wall 92 is provided with a recessed portion 93 that exposes an engaging portion 172, which will be described later, in the Y direction.

The first pressing portion 80 is an example of another pressing portion that presses a first holder 96 (FIG. 9), which will be described later, so that the retard roller 52 (FIG. 3) comes into contact with the feeding roller 46 (FIG. 3). Specifically, the first pressing portion 80 has, as an example, a pressing lever 83 and a coil spring 85.

The coil spring 85 is attached to a frame (not shown) and protrudes in the +Z direction from the front wall 75 through the through hole 75A.

The pressing lever 83 has, as an example, two extending portions 83A, a cap portion 83B, and a contact portion 83C.

The two extending portions 83A are disposed at an interval in the Y direction and extend in the X direction, respectively. Coupling pins (not shown) are formed at respective end portions of the two extending portions 83A in the +X direction. The coupling pins are coupled to the coupling holes (not shown) of the ribs 84. As a result, the pressing lever 83 is rotatable around the coupling pins.

The cap portion 83B couples the end portions of the two extending portions 83A in the −X direction in the Y direction. Further, the cap portion 83B is attached to the end portion of the coil spring 85 in the +Z direction.

The contact portion 83C is a part protruding in the +Z direction at the central portion of the cap portion 83B in the Y direction. Further, the contact portion 83C is formed in a semi-cylindrical shape extending in the Y direction.

The pressing lever 83 is pressed in the +Z direction by the coil spring 85. In addition, when the contact portion 83C comes into contact with a curved wall 99 (FIG. 9), which will be described later, from the −Z direction, the first holder 96 (FIG. 9) is pressed in the +Z direction.

As shown in FIG. 8, the holder portion 94 includes the first holder 96 that rotatably holds the retard roller 52 and the second holder 114 that holds the first holder 96 to be swingable. That is, the holder portion 94 rotatably holds the retard roller 52. Further, the holder portion 94 comes into contact with an engaging portion 172 and a second restricting portion 182 (FIG. 7) which will be described later.

The holder portion 94 is accommodated in the accommodating portion 70 (FIG. 7). At least a part of the holder portion 94 in the +Z direction is exposed to the outside from the base guide 62 (FIG. 7).

Here, the retard roller 52, the torque limiter 55, the holder portion 94, and the guide plate 142, which will be described later, are collectively referred to as a detachable unit 90. The detachable unit 90 can be attached to and detached from the accommodating portion 70. In other words, the holder portion 94 is detachably provided in the accommodating portion 70.

Figure 9:
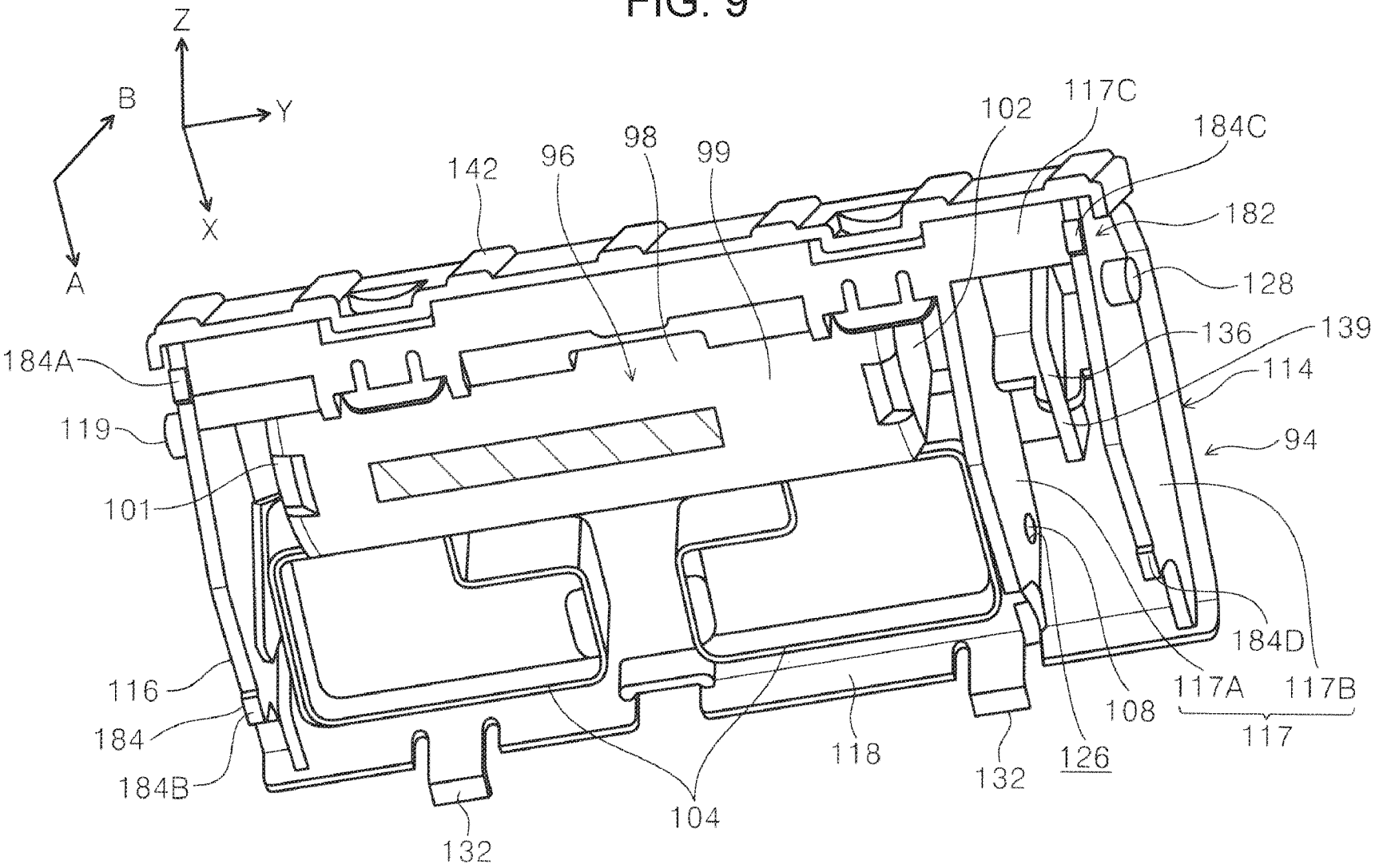
FIG. 9 is a perspective view showing a back side of the detachable unit of the feeding unit according to the first embodiment.
Figure 10:
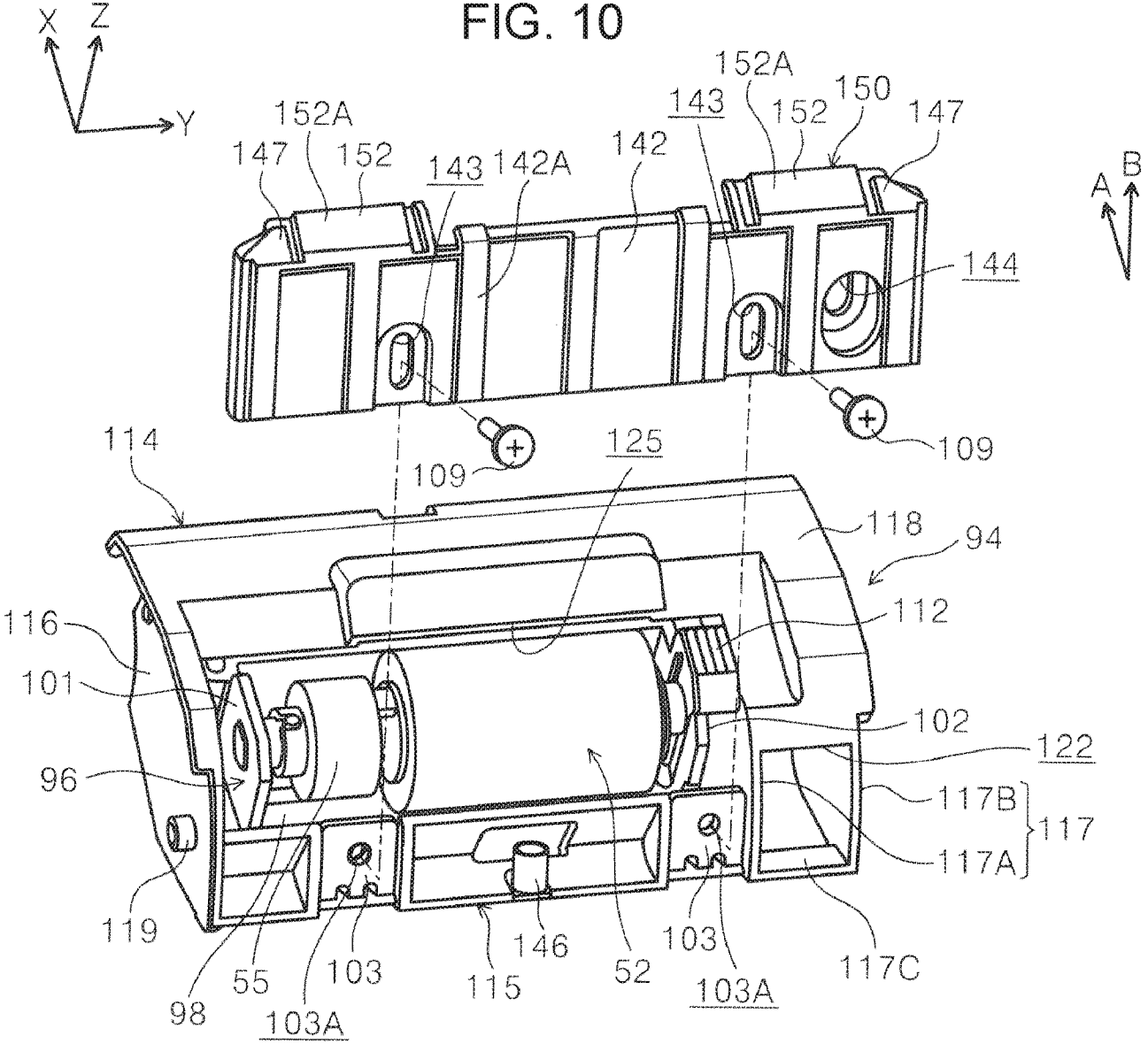
FIG. 10 is an exploded perspective view of a part of the detachable unit of the feeding unit according to the first embodiment.

As shown in FIGS. 9 and 10, the first holder 96 includes a roller accommodating portion 98, a knob portion 104, a coupling pin 108, and a knob 112. In addition, the first holder 96 holds the retard roller 52 and the torque limiter 55.

The roller accommodating portion 98 is formed in a semi-cylindrical shape and has the curved wall 99, the left side wall 101, and the right side wall 102. The curved wall 99 is formed to be able to accommodate a part of the retard roller 52.

The knob portion 104 is provided in the roller accommodating portion 98 and is elastically deformable in the Y direction.

The coupling pin 108 protrudes from the knob portion 104 in the +Y direction and the −Y direction. The coupling pin 108 in the −Y direction is not shown in the drawing. When the knob portion 104 is elastically deformed, the coupling pin 108 is coupled to a left frame 116 and a right frame 117, which will be described later. As a result, the first holder 96 can rotate relative to the second holder 114.

The knob 112 is provided on the right side wall 102. When receiving an external force, the knob 112 transmits the external force to the roller accommodating portion 98 and the knob portion 104 to rotate the roller accommodating portion 98 and the knob portion 104 around the coupling pin 108.

When the knob 112 is operated in a direction including a component in the −Z direction, the retard roller 52 is separated from the feeding roller 46 (FIG. 3).

As shown in FIG. 10, the second holder 114 includes, for example, a front frame 115, the left frame 116, the right frame 117, and an upper frame 118. A space portion surrounded by the front frame 115, the left frame 116, the right frame 117, and the upper frame 118 is an opening portion 125.

The front frame 115 constitutes a part in the −X direction and −Z direction with respect to the center of the second holder 114. Further, the front frame 115 extends in the Y direction. A lower end portion of a coil spring 146 which will be described later is in contact with the front frame 115.

The left frame 116 is a wall portion that stands upright along the X-Z plane and is coupled to the end portion of the front frame 115 in the −Y direction. The end portion of the left frame 116 in the −Z direction has a shape which can be in surface contact with the bottom wall 72 and the front wall 75 (FIG. 7). The dowel 119 is provided at a position of the left frame 116 in the −X direction and the −Z direction.

The dowel 119 is formed in a cylindrical shape and protrudes from the left frame 116 in the −Y direction. A coupling hole (not shown) is formed at a position of the left frame 116 in the +X direction and +Z direction.

The right frame 117 has vertical walls 117A and 117B are disposed at an interval in the Y direction. The vertical wall 117A and the vertical wall 117B stand upright along the X-Z plane. The vertical wall 117A is coupled to the end portion of the front frame 115 in the −Y direction. The vertical wall 117B is positioned in the +Y direction with respect to the vertical wall 117A. The part of the vertical wall 117A in the −X direction and the −Z direction and the part of the vertical wall 117B in the −X direction and −Z direction are coupled by the bottom wall 117C.

A window portion 122 is formed by the vertical walls 117A and 117B and the bottom wall 117C. In a state in which the second holder 114 is accommodated in the accommodating portion 70 (FIG. 7) and the guide plate 142 is not attached, the window portion 122 exposes the mounting plate 82 (FIG. 7) in the −X direction. As a result, the guide plate 142 is able to be fixed to the mounting plate 82.

The upper frame 118 is formed in a U shape opening in the −X direction when viewed from the Z direction. Further, the upper frame 118 covers the left frame 116 and the right frame 117 from the +Z direction.

A coupling hole 126 (FIG. 9) is formed at a position of the vertical wall 117A in the +X direction and the +Z direction. The dowel 128 (FIG. 9) is provided at a position of the vertical wall 117B in the −X direction and the −Z direction. The dowel 128 is formed in a cylindrical shape and protrudes from the vertical wall 117B in the +Y direction. Further, the dowel 128 is disposed on the same axial line as the dowel 119.

The dowel 119 and the dowel 128 are examples of engaged portions provided on both end portions of the second holder 114 in the Y direction.

As shown in FIG. 9, two protruding portions 132 are provided at the end portion of the upper frame 118 in the +X direction. The two protruding portions 132 are disposed at an interval in the Y direction.

The protruding portion 132 is formed in an L shape when viewed from the Y direction, and is elastically deformable in the X direction. The protruding portion 132 can swing the edge portion 88 (FIG. 7) while maintaining a state of being in contact with the edge portion 88. In other words, the protruding portion 132 serves as a fulcrum for swinging the holder portion 94 when viewed from the Y direction.

A pressed portion 136 is provided at a part of the upper frame 118 between the vertical wall 117A and the vertical wall 117B.

The pressed portion 136 extends from the upper frame 118 in the −Z direction. Further, the pressed portion 136 is, as an example, formed in a cross shape when viewed in the +Z direction. A pressed surface 139 is formed at an end portion of the pressed portion 136 in the −Z direction. A second pressing portion 156 (FIG. 7), which will be described later, comes into contact with the pressed surface 139. In this manner, the pressed portion 136 is a part that is pressed by the second pressing portion 156 in the +Z direction.

The first holder 96 and the second holder 114 are coupled by the coupling pin 108 or the like. In addition, the first holder 96 is swung when an external force is applied to the first holder 96.

As shown in FIG. 10, a sheet metal member 103 is attached to the front frame 115. A screw hole 103A is formed in the sheet metal member 103. A screw 109 can be fastened to the screw hole 103A. Here, the guide plate 142 is provided on the second holder 114.

The guide plate 142 is provided on the front frame 115 of the second holder 114. In other words, the guide plate 142 is provided on the holder portion 94.

As shown in FIG. 3, the guide plate 142 is an example of a guide portion that guides the downstream end of the paper P in the +A direction toward the feeding roller 46. Specifically, in a state in which the guide plate 142 is attached to the second holder 114 (FIG. 10), the guide plate 142 guides the downstream end of the paper P in the +A direction, the paper P being lifted by the lifter 29, toward the outer peripheral surface 48A of the feeding roller 46.

As shown in FIG. 10, the guide plate 142 is formed in a rectangular shape whose dimension in the Y direction is longer than the dimension in the B direction. In a state in which the guide plate 142 is attached to the second holder 114 and the second holder 114 is accommodated in the accommodating portion 70 (FIG. 7), an inclined state is made in which an end portion in the +B direction is positioned in the +A direction from an end portion in the −B direction. A surface of the guide plate 142 with which the end portion of the paper P can come into contact is a guide surface 142A. The inclination direction of the guide surface 142A and the inclination direction of the guide plate 142 are aligned.

Two adjustment holes 143 and one hole portion 144 are formed at the end portion of the guide plate 142 in the −Z direction.

The two adjustment holes 143 are long holes respectively extending in the B direction. Further, the two adjustment holes 143 are disposed at an interval in the Y direction so as to be able to communicate with the two screw holes 103A.

The hole portion 144 is positioned in the +Y direction from the adjustment hole 143 in the +Y direction and positioned at the end portion of the guide plate 142 in the +Y direction.

Two flange portions 147 are formed at the end portions of the guide plate 142 in the +B direction.

The two flange portions 147 are plate parts extending from both end portions of the guide plate 142 in the Y direction toward the +A direction. The two flange portions 147 are provided with the handling portions 150 which will be described later. In other words, the handling portions 150 are provided integrally with the guide plate 142 and can come into contact with the paper P.

One end portion of the coil spring 146 in the axial direction is attached to the front frame 115. The coil spring 146 is elastically deformable with the B direction as the axial direction. As a result, when the coil spring 146 comes into contact with the end portion of the guide plate 142 in the −B direction before being fixed, the guide plate 142 is supported to be displaced in the B direction.

When the end portion of the guide plate 142 in the −B direction before being fixed comes into contact with the coil spring 146 in a state in which the screw 109 is loosened from the screw hole 103A, the coil spring 146 presses the guide plate 142 toward the feeding roller 46. (FIG. 3). In this state, when the magnitude of the external force applied to the guide plate 142 changes, the position of the guide plate 142 in the +B direction changes.

The handling portion 150 handles the paper P toward the feeding roller 46 (FIG. 3). A plurality of handling portions 150 are provided on the guide plate 142 at an interval in the Y direction. Specifically, the plurality of handling portions 150 are configured by two first pads 152.

The two first pads 152 are provided on the flange portions 147. Further, the two first pads 152 are positioned outside in the Y direction with respect to the outer peripheral surface 48A of the feeding roller 46 (FIG. 3) when viewed from the +A direction.

The first pad 152 in the −Y direction is an example of one handling portion. The first pad 152 in the +Y direction is an example of another handling portion.

The first pad 152 is a rectangular board having a dimension in the Y direction larger than a dimension in the +A direction. The first pad 152 is, as an example, made of a resin member. The first pad 152 may be made of an elastic member such as rubber. The first pad 152 is adhered to the flange portion 147. A handling surface 152A, which is a surface of the first pad 152 in the +B direction, comes into contact with the paper P. A frictional coefficient μ1 in contact between the handling surface 152A and the paper P is set to a predetermined value.

Figure 11:
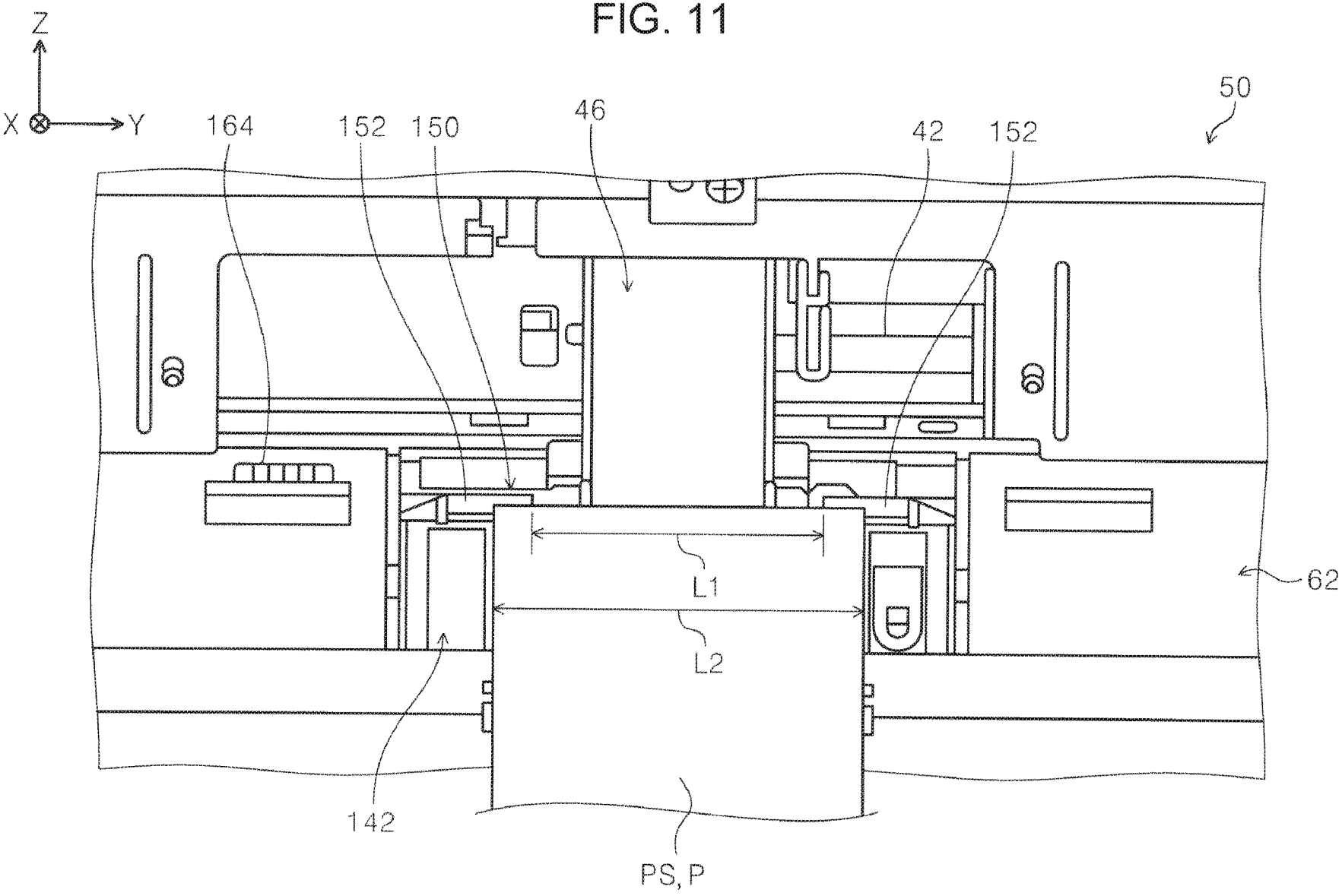
FIG. 11 is a view showing a positional relationship between a handling portion of the feeding unit and a tip end of paper having a minimum size according to the first embodiment.

As shown in FIG. 11, the size of the interval between the two first pads 152 in the Y direction is smaller than the size of paper PS having the smallest size among the fed paper P in the Y direction. A length L1 [mm] is assumed which corresponds to an interval from an end surface of the +Y direction of the first pad 152 in the −Y direction to an end surface of the −Y direction of the first pad 152 in the +Y direction. A length L2 [mm] is assumed which corresponds to the width of the paper PS in the Y direction. Here, L1<L2. In other words, when the paper PS is fed by the center registration method, both end portions of the paper PS in the Y direction come into contact with the two first pads 152.

Figure 12:
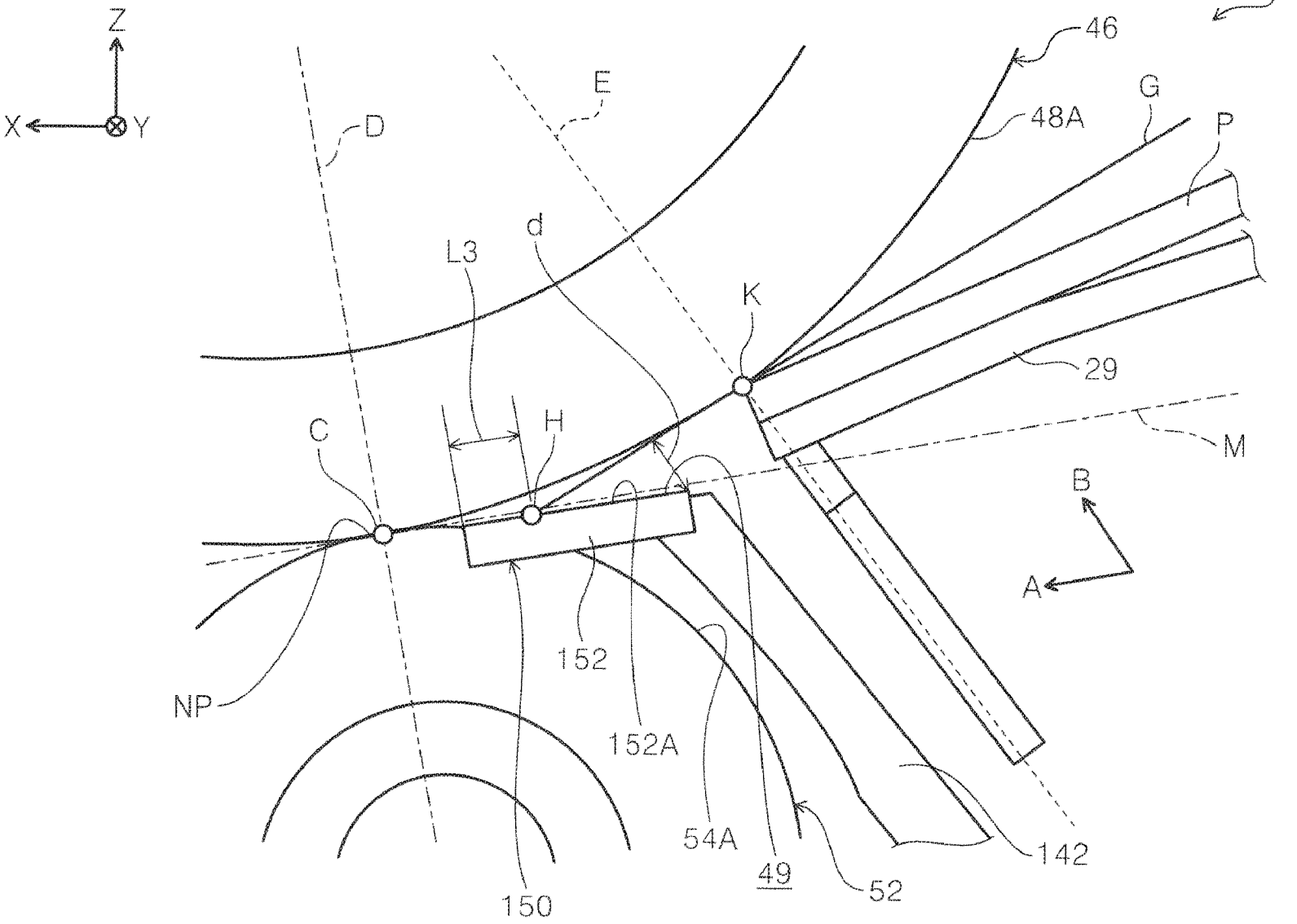
FIG. 12 is a schematic diagram showing a path from a lifter to a nip portion via the handling portion in the feeding unit according to the first embodiment.

FIG. 12 shows a state in which one sheet of paper P is lifted by the lifter 29.

The nip portion NP is formed by contact between the feeding roller 46 and the retard roller 52. In a state in which the feeding roller 46 and the retard roller 52 are in line contact with each other, the nip portion NP is formed linearly along the Y direction. In a state in which the feeding roller 46 and the retard roller 52 are in surface contact with each other, the nip portion NP is formed in a belt-like shape having a predetermined width in the +A direction and extending in the Y direction. A virtual point C at the center of the nip portion NP in the +A direction is assumed, and a tangent line of the outer peripheral surface 48A passing through the virtual point C is used as a reference line M. The virtual point C is a separation nip point where the paper P is separated. A line passing through the virtual point C and perpendicular to the reference line M is assumed as a perpendicular line D.

The handling surface 152A extends along the reference line M when viewed from the Y direction.

The guide plate 142 forms a frontage 49 through which the paper P can pass between the guide plate 142 and the outer peripheral surface 48A. The guide plate 142 is provided so that the size of the frontage 49 can be adjusted. Specifically, the frontage 49 is defined between the end portion of the handling surface 152A in the −A direction and the outer peripheral surface 48A. The guide plate 142 is provided on the second holder 114 (FIG. 8) so that an interval d [mm] of the frontage 49 in the +B direction can be adjusted. The interval d is adjusted by shifting the position of the guide plate 142 in the +B direction or the −B direction in a state in which a spacer having a predetermined thickness is interposed between the outer peripheral surface 48A and the handling surface 152A.

After the position of the guide plate 142 in the +B direction is determined, the guide plate 142 is attached to the second holder 114 using the screw 109 (FIG. 10).

In FIG. 12, an extension line E obtained by extending the movement locus of the tip end of the lifter 29 in the +A direction is indicated by a dashed line. A point K is a point at which the paper P is picked on the outer peripheral surface 48A of the feeding roller 46. When the lifter 29 lifts one sheet of paper P, the point K is positioned on the extension line E. Further, the tangent line of the outer peripheral surface 48A passing through the point K is a tangent line G. A tangent line G is an entrance line of the paper P toward the nip portion NP from the lifter 29. The tangent line G intersects the handling surface 152A when viewed from the Y direction. A point H indicates a position where the tangent line G and the handling surface 152A intersect.

The length from the point H to the end of the handling surface 152A in the +A direction is L3 [mm]. The length L3 corresponds to a distance that the paper P slides on the handling surface 152A.

Figure 13:
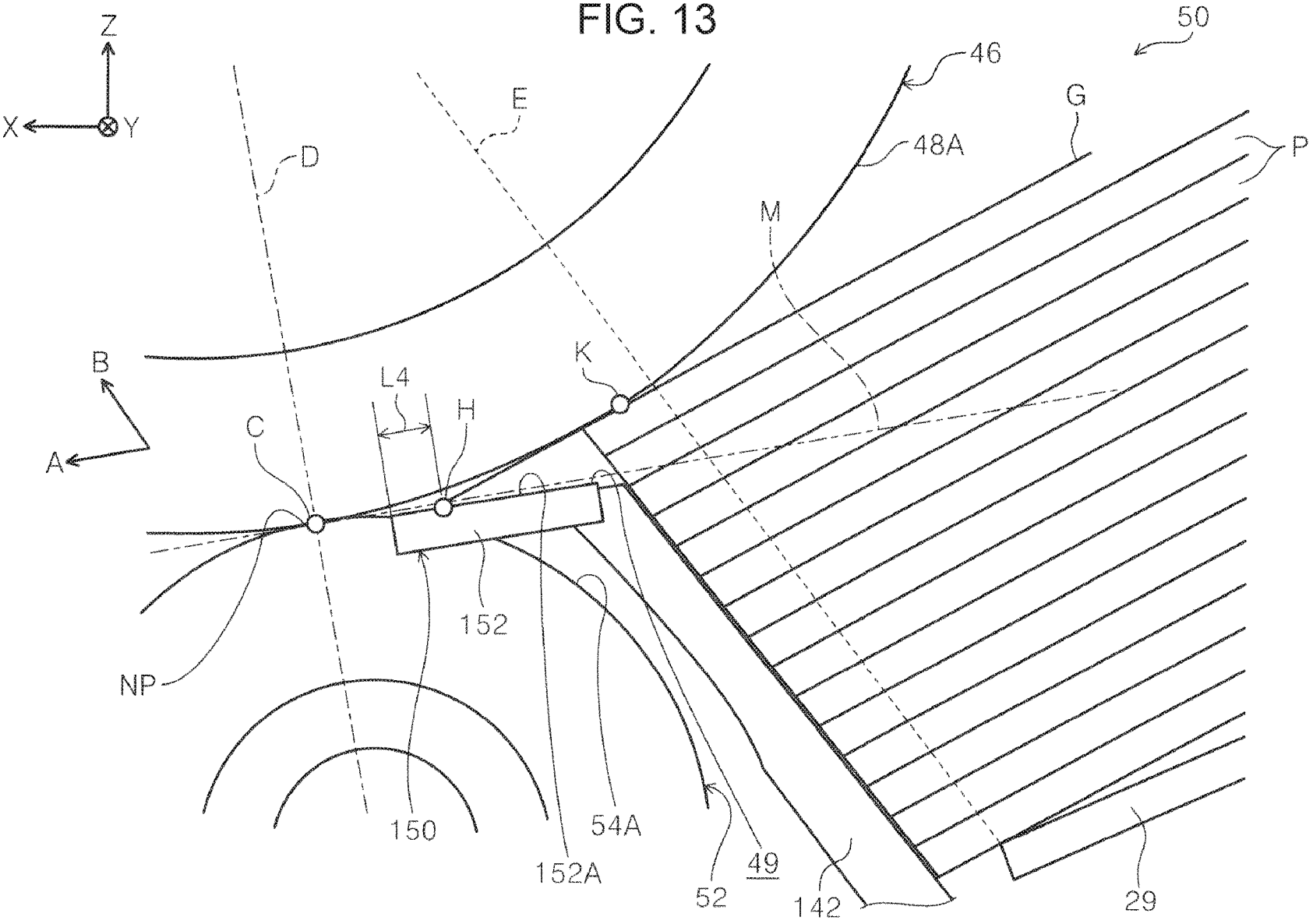
FIG. 13 is a schematic diagram showing the path from the lifter to the nip portion via the handling portion in the feeding unit according to the first embodiment, together with a plurality of sheets.

As shown in FIG. 13, when a large number of sheets of paper P are stacked on the lifter 29, the weight of the paper P lowers the paper P, so that the interval between the paper P and the lifter 29 becomes smaller. That is, the inclination angle of the paper P becomes smaller. Therefore, the point K is shifted in the +X direction with respect to the extension line E, and an angle formed by the tangent line G and the reference line M becomes smaller. As a result, the approach angle of the paper P with respect to the handling portion 150 becomes shallow, and the point H shifts in the +X direction. Due to the application, the length from the point H to the end of the handling surface 152A in the +A direction becomes a length L4 [mm], which is shorter than the length L3 (FIG. 12). In the present embodiment, even in a state in which the length is L4, the handling effect of the paper P by the handling portion 150 can be obtained.

As shown in FIG. 6, an outer handling portion 167 is provided outside the handling portion 150 in the Y direction in the base guide 62.

The outer handling portion 167 handles the paper P toward the feeding roller 46 (FIG. 3). As an example, a plurality of outer handling portions 167 are provided at an interval in the Y direction. Specifically, the plurality of outer handling portions 167 are configured by two second pads 168.

The two second pads 168 are attached to the upper wall portion 64 through adhesion.

The second pad 168 is a rectangular board having a dimension in the Y direction larger than a dimension in the +A direction. The second pad 168 is, as an example, made of a resin member. The second pad 168 may be made of an elastic member such as rubber. An outer handling surface 168A of the second pad 168 in the +B direction comes into contact with the paper P. A value of the frictional coefficient μ2 in the contact of the outer handling surface 168A with the paper P is set within a predetermined range. As an example, μ2=μ1.

Figure 14:
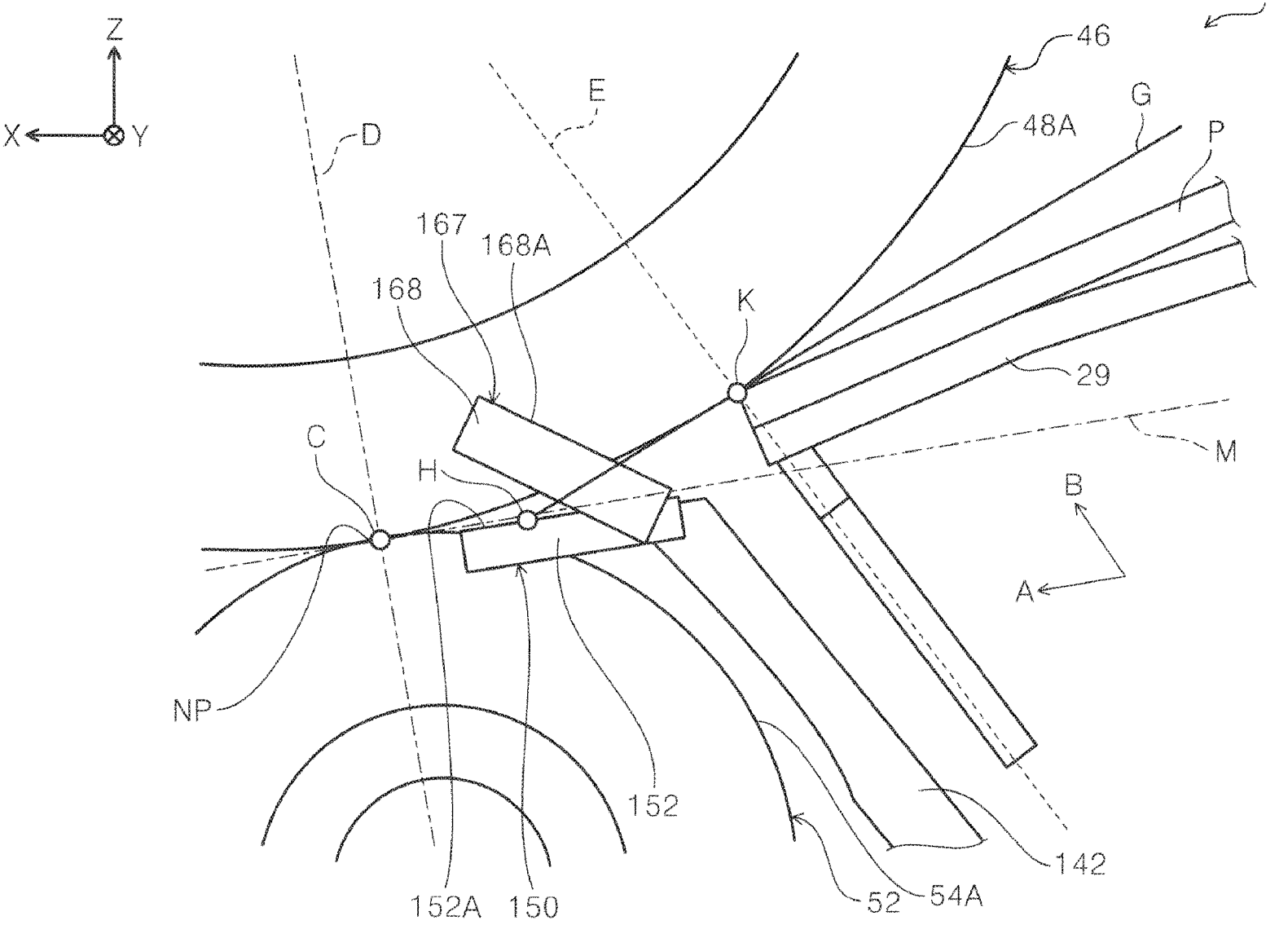
FIG. 14 is a schematic diagram showing the handling portion and an outer handling portion of the feeding unit according to the first embodiment, together with a paper path.

FIG. 14 shows the positional relationship between the handling portion 150 and the outer handling portion 167 when viewed from the Y direction.

The outer handling surface 168A of the outer handling portion 167 that comes into contact with the paper P is positioned above the handling surface 152A of the handling portion 150 that comes into contact with the paper P in the Z direction.

An angle between the outer handling surface 168A and the X direction is larger than an angle between the handling surface 152A and the X direction.

Figure 15:
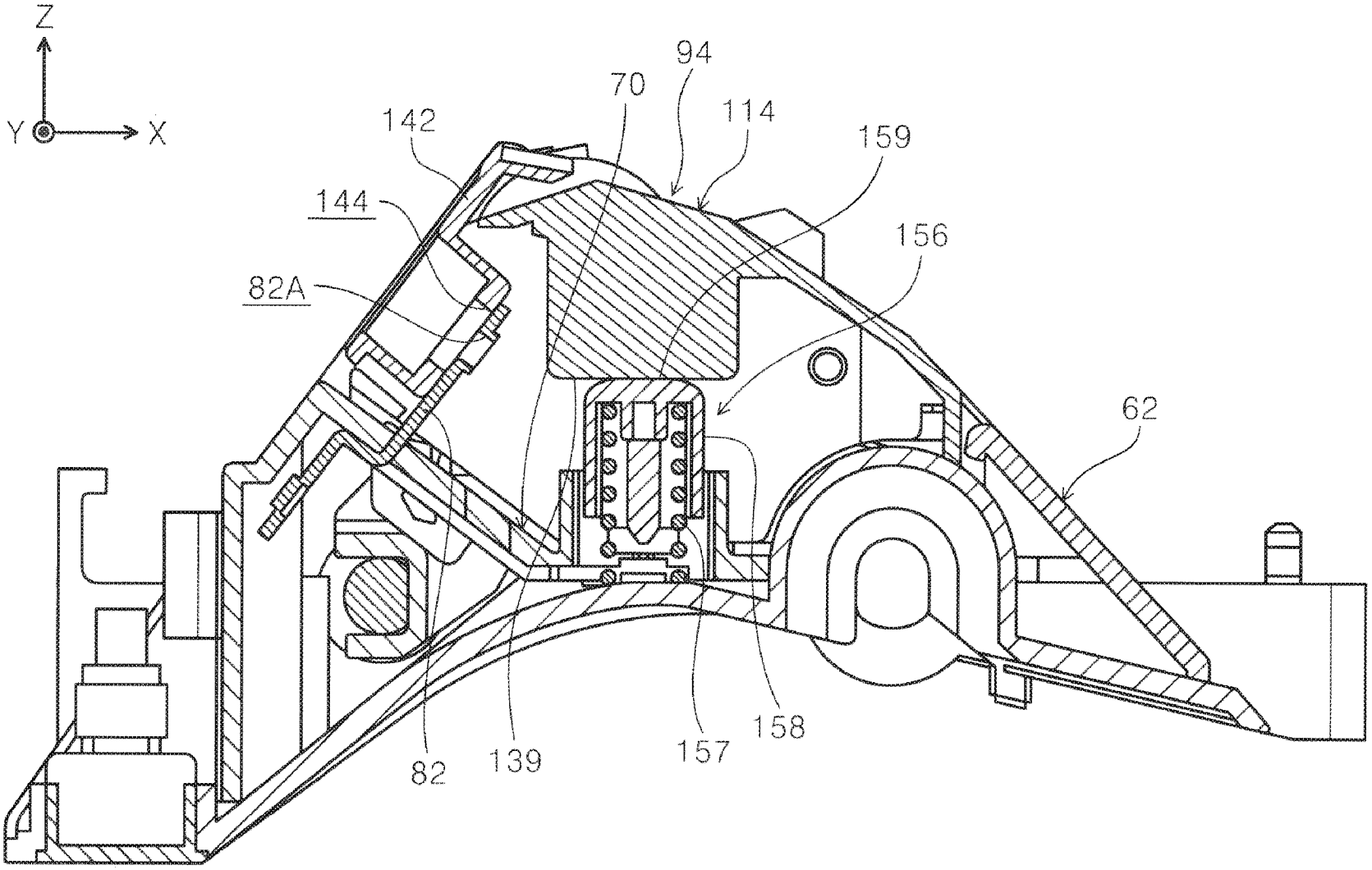
FIG. 15 is a diagram showing a state in which the detachable unit is accommodated in the base guide in the feeding unit according to the first embodiment.

As shown in FIG. 15, the second pressing portion 156 is an example of a pressing portion that presses the second holder 114 in the +Z direction in which the second holder 114 is separated from the accommodating portion 70. The second pressing portion 156 has a coil spring 157 and a cap 158.

The coil spring 157 is disposed such that its axial direction substantially extends along the Z direction. The end portion of the coil spring 157 in the −Z direction is attached to a part of the base guide 62. Further, the coil spring 157 extends in the +Z direction between the two guide walls 74 (FIG. 7).

The cap 158 is a hollow with an open part in the −Z direction, that is, a cuboid member. The end portion of the coil spring 157 in the +Z direction is attached to the cap 158. As a result, the pressing force in the +Z direction is applied to the cap 158 by the coil spring 157. When the cap 158 is sandwiched between the two guide walls 74, the cap 158 is restricted for the movement in the Y direction and guided in the Z direction.

The end portion of the cap 158 in the +Z direction has a contact surface 159 substantially along the X-Y plane. When the contact surface 159 comes into contact with the pressed surface 139 of the second holder 114, the second holder 114 is pressed in the +Z direction. In this manner, the second pressing portion 156 presses the holder portion 94 in the +Z direction.

Figure 16:
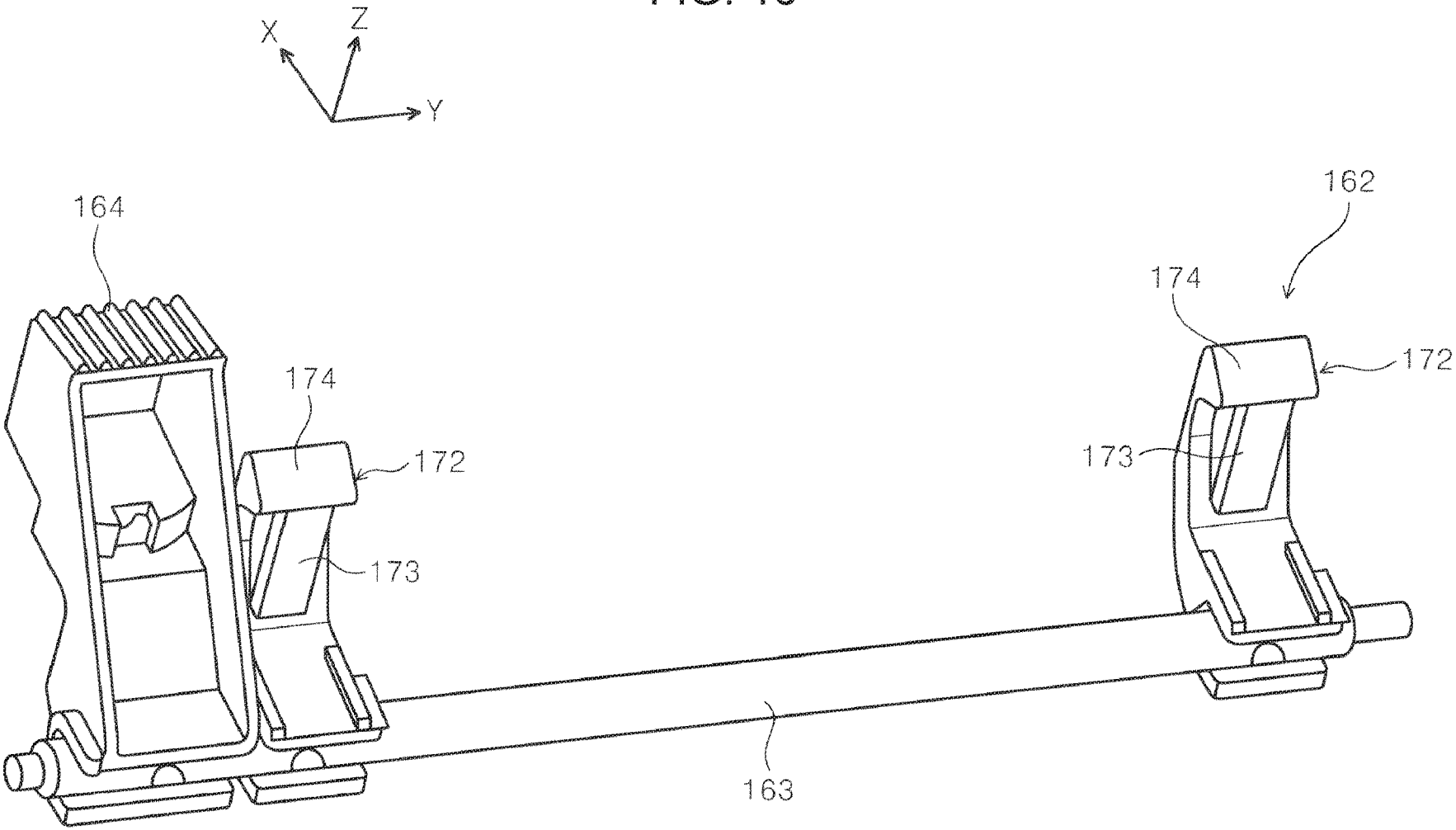
FIG. 16 is a perspective view of a release lever of the feeding unit according to the first embodiment.

As shown in FIG. 16, the release lever 162 is an example of a first restricting portion that restricts the movement of the second holder 114 (FIG. 15) in the +Z direction. The release lever 162 has, as an example, a shaft portion 163, an operating portion 164, and two engaging portions 172.

The shaft portion 163 is formed in a columnar shape extending in the Y direction. Both end portions of the shaft portion 163 in the Y direction are rotatably supported by a support portion (not shown) provided on the base guide 62 (FIG. 15). A torsion spring (not shown) is provided on the shaft portion 163. As a result, a pressing force is applied to the shaft portion 163 to press the engaging portion 172, which will be described later, toward the restricting position.

The operating portion 164 extends in the radial direction of the shaft portion 163 from the end portion of the shaft portion 163 in the −Y direction. The end portion of the operating portion 164 in the +Z direction is exposed at the base guide 62 (FIG. 5). As a result, the operation of the operating portion 164 is enabled. When the operating portion 164 is pushed down in the −Z direction, the shaft portion 163 is rotated. The rotation direction of the shaft portion 163 at this time is a direction in which the two engaging portions 172 are separated from the dowel 119 and the dowel 128 (FIG. 9). In this manner, when the operating portion 164 is operated, the engaging portion 172 is swingable.

The two engaging portions 172 are provided on the shaft portion 163 at an interval in the Y direction. When the engaging portion 172 is engaged with the dowel 119 and the dowel 128, the engaging portion 172 restricts the movement of the second holder 114 in the +Z direction. As an example, the engaging portion 172 includes an arm portion 173 that extends from the shaft portion 163 in the radial direction of the shaft portion 163 and is bent, and a peak portion 174 that is provided on a side opposite to the shaft portion 163 of the arm portion 173.

The peak portion 174 is a trapezoidal part when viewed from the Y direction. Further, the peak portion 174 is exposed to the inside of the accommodating portion 70 in the recessed portion 93 (FIG. 7). In addition, the peak portion 174 is then engaged with the dowel 119 and the dowel 128 (FIG. 9).

The engaging portion 172 is provided to be swingable between the restricting position where the peak portion 174 is engaged with the dowel 119 and the dowel 128 and the retreat position where the peak portion 174 is retreated from the dowel 119 and the dowel 128. Further, the engaging portion 172 presses the dowel 119 and the dowel 128 against the vertical wall portion 76 (FIG. 7) in a state of being engaged with the dowel 119 and the dowel 128.

Figure 17:
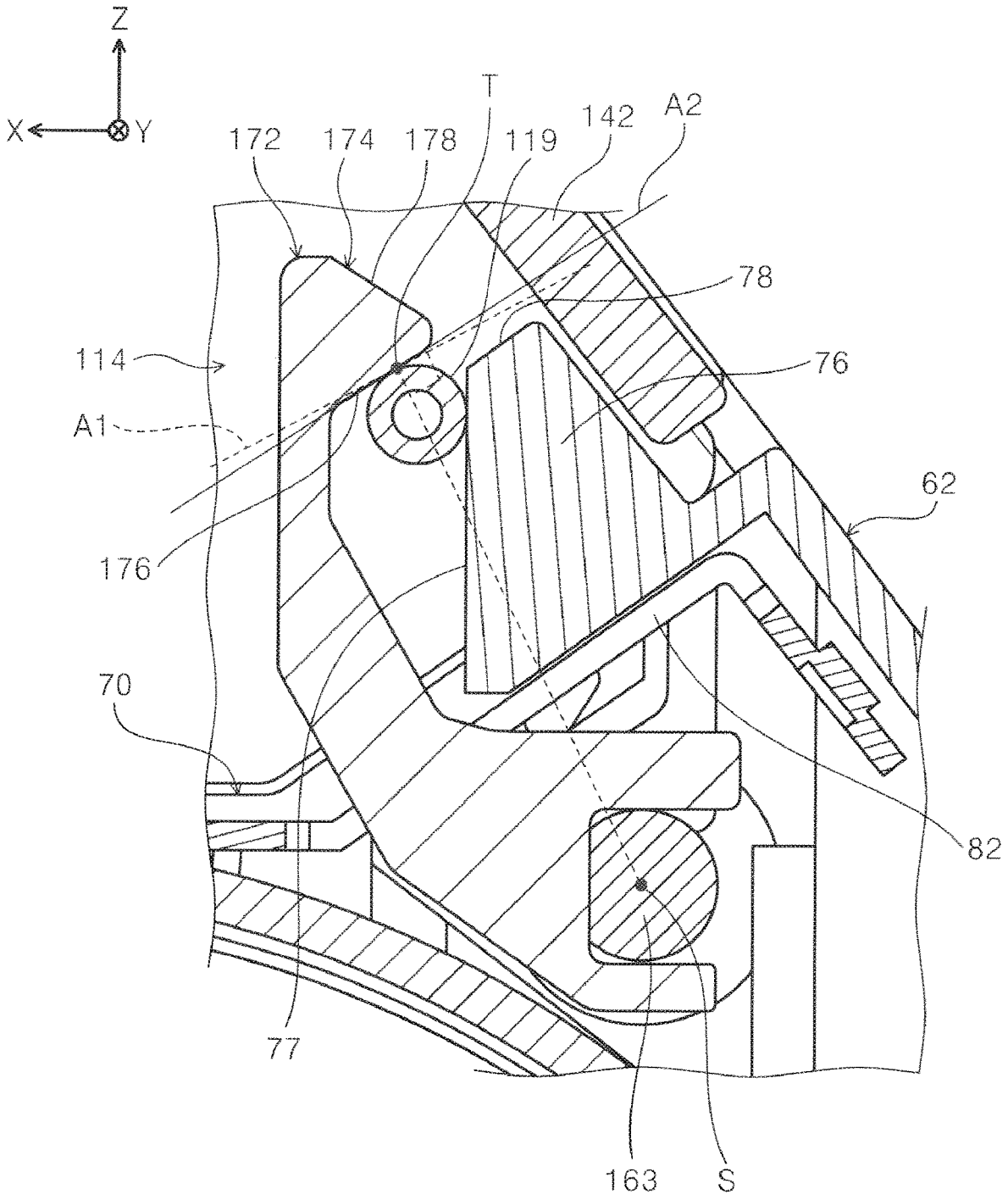
FIG. 17 is a vertical cross-sectional diagram showing a state in which an engaging portion of the release lever and a dowel of a second holder are engaged in the feeding unit according to the first embodiment.

As shown in FIG. 17, the engaging portion 172 has a first inclined surface 176 and a second inclined surface 178 formed on the peak portion 174 when viewed from the Y direction.

When the first inclined surface 176 comes into contact with the dowel 119 and the dowel 128, a pressing force including a component in the −Z direction is applied to the dowel 119 and the dowel 128 (FIG. 9).

When the second inclined surface 178 comes into contact with the dowel 119 and the dowel 128, a pressing force including a component in the +Z direction is applied to the dowel 119 and the dowel 128.

When viewed in the +Y direction, a central point of the shaft portion 163 is a point S. A contact point between the first inclined surface 176 and the outer peripheral surface of the dowel 119 in the engagement state is a point T. A line perpendicular to a line segment ST is a line A1. Further, a line extending from the first inclined surface 176 is a line A2.

Here, with respect to the point T, the line A2 is inclined more counterclockwise than the line A1. The counterclockwise direction is a direction in which the engaging portion 172 is separated from the dowel 119 and the dowel 128. That is, in the engaging portion 172, the inclination of the first inclined surface 176 is adjusted so as to be easily retreated from the dowel 119 and the dowel 128.

Figure 18:
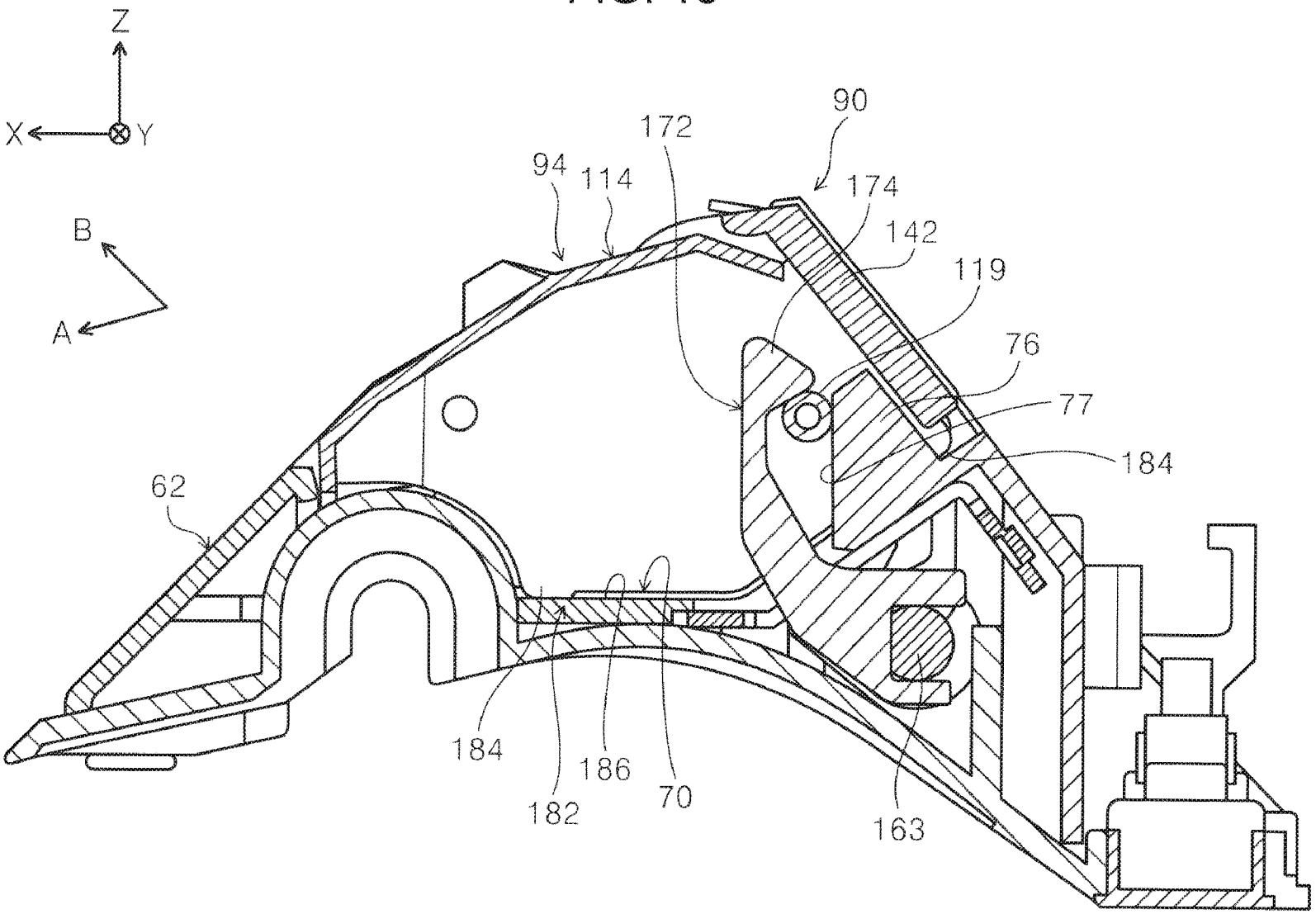
FIG. 18 is a diagram showing a state in which the detachable unit is attached to the base guide in the feeding unit according to the first embodiment.

As shown in FIG. 18, in a state in which the detachable unit 90 is accommodated in the accommodating portion 70, the second restricting portion 182 restricts the movement of the second holder 114 in the −Z direction.

The second restricting portion 182 has, as an example, a restricting surface 186 provided in the accommodating portion 70.

As shown in FIG. 9, as an example, a total of four restricted portions 184 are provided in the second holder 114. In the following description, there is a case where the four restricted portions 184 are distinguished as restricted portions 184A, 184B, 184C, and 184D. When the four restricted portions 184 are not distinguished, the restricted portions are simply described as restricted portion 184.

Two of each of the four restricted portions 184 are provided at an interval in the Y direction and the +A direction. That is, the four restricted portions 184 are disposed at the vertices of a rectangle having sides in the Y direction and sides in the +A direction.

The restricted portion 184A is a convex portion that protrudes in the −B direction from the end portion of the left frame 116 positioned in the −Z direction and the −X direction.

The restricted portion 184B is a convex portion that protrudes in the −Z direction from the end portion of the left frame 116 positioned in the −Z direction and the +X direction.

The restricted portion 184C is a convex portion that protrudes in the −B direction from the end portion of the vertical wall 117B positioned in the −Z direction and the −X direction.

The restricted portion 184D is a convex portion that protrudes in the −Z direction from the end portion of the vertical wall 117B positioned in the −Z direction and the +X direction.

In this manner, the restricted portion 184B is positioned in the +A direction with respect to the restricted portion 184A. The restricted portion 184C is positioned in the +Y direction with respect to the restricted portion 184A. The restricted portion 184D is positioned in the +Y direction with respect to the restricted portion 184B and in the +A direction with respect to the restricted portion 184C.

Figure 19:
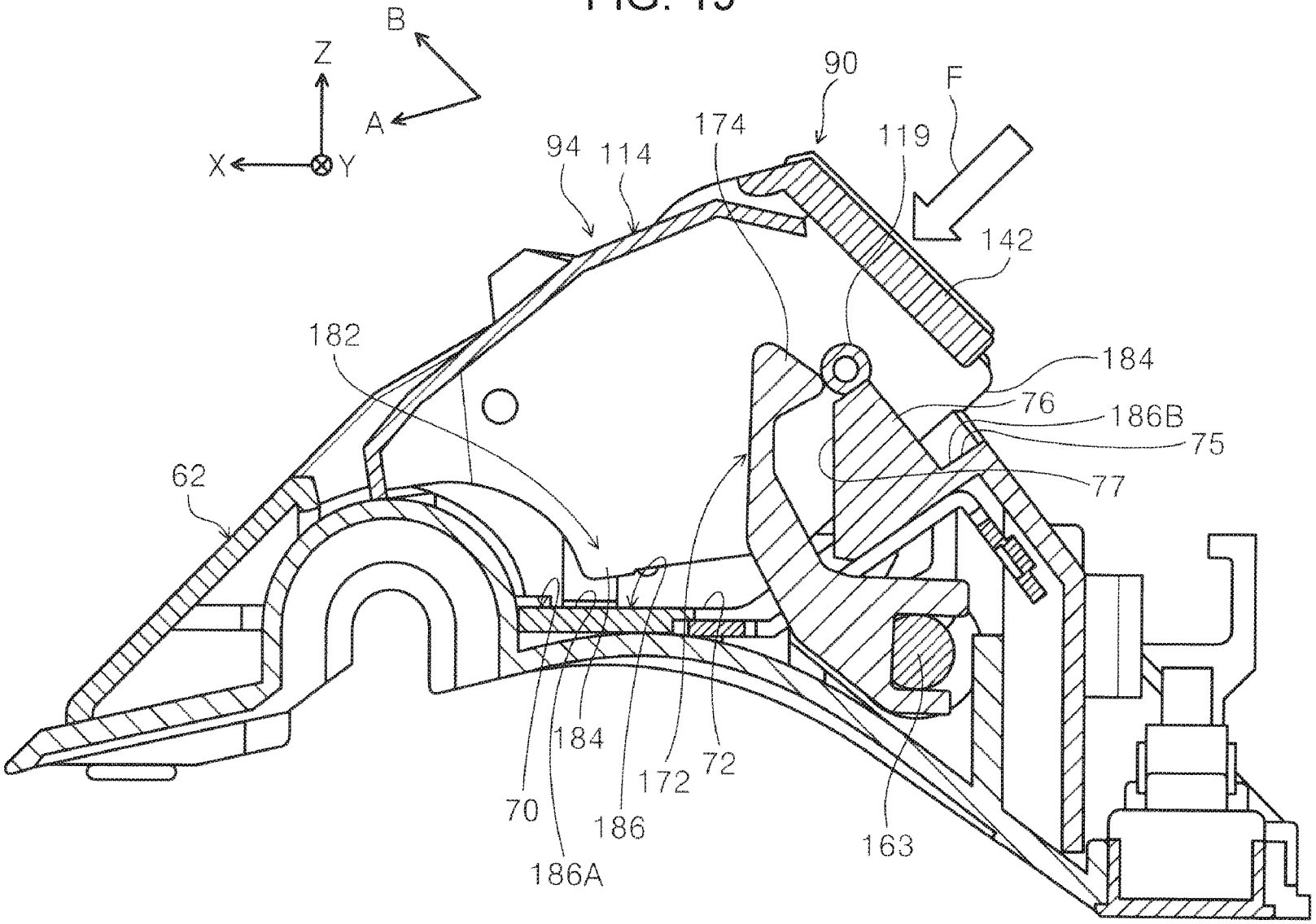
FIG. 19 is a diagram showing a state in which restriction on the detachable unit is released in the feeding unit according to the first embodiment.

As shown in FIG. 19, the restricting surface 186 is provided in the accommodating portion 70 and is a surface that can come into contact with the four restricted portions 184.

The restricting surface 186 includes, as an example, an upper surface 186A of the bottom wall 72 in the +Z direction and an upper surface 186B of the front wall 75 in the +B direction.

Here, when the restricted portions 184A and 184C come into contact with the upper surface 186A and the restricted portions 184B and 184D come into contact with the upper surface 186B, the movement of the second holder 114 in the −Z direction is restricted.

Figure 20:
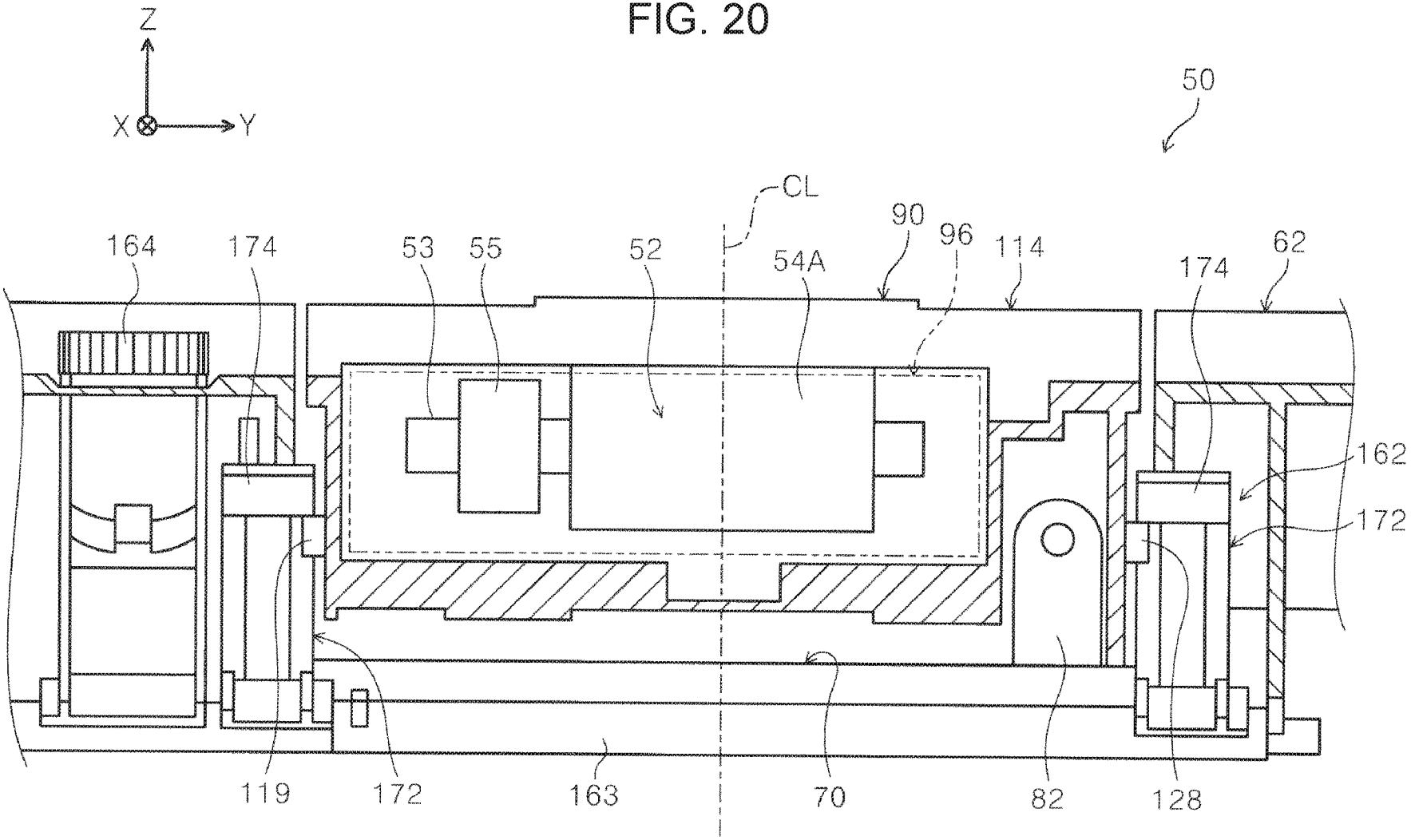
FIG. 20 is a front diagram showing an engagement state between the release lever and the detachable unit of the feeding unit according to the first embodiment.

As shown in FIG. 20, the detachable unit 90 is accommodated in the accommodating portion 70. This state is referred to as an accommodated state of the detachable unit 90. Further, a line passing through the center of the outer peripheral surface 54A of the retard roller 52 in the Y direction and along the Z direction is a central line CL.

In the accommodated state, when the dowel 119 is engaged with the engaging portion 172 in the −Y direction, movement in the +Z direction is restricted at a part of the detachable unit 90 in the −Y direction with respect to the central line CL. When the dowel 128 is engaged with the engaging portion 172 in the +Y direction, the movement in the +Z direction is restricted at a part of the detachable unit 90 in the +Y direction with respect to the central line CL.

Further, when the four restricted portions 184 (FIG. 9) of the second holder 114 come into contact with the restricting surface 186 (FIG. 19), the movement in the −Z direction is restricted.

In this manner, in the accommodated state, the movement of the detachable unit 90 is restricted in the +Z direction and the −Z direction.

Next, replacement of the feeding roller 46 and the retard roller 52 will be described. There is a case where description of individual figure number is omitted for each configuration.

As shown in FIGS. 3 and 4, when the feeding roller 46 and the retard roller 52 are replaced, the paper feeding tray 21 is opened and the roller cover 36 is removed. When the knob 112 of the first holder 96 is pushed down, the pressing state of the feeding roller 46 is released. In addition, the feeding roller 46 is removed in the −Y direction.

Subsequently, as shown in FIGS. 18 and 19, when the operating portion 164 is operated to be released, the engaging portion 172 is moved to the retreat position separated from the second holder 114. At this time, when the pressing force of the second pressing portion 156 is applied to the second holder 114, the detachable unit 90 is lifted in the +Z direction. In addition, the detachable unit 90 is taken out.

Subsequently, as shown in FIG. 9, when the knob portion 104 is operated, the first holder 96 is removed from the second holder 114. At this time, the retard roller 52 and the torque limiter 55 are also removed together. A new first holder 96, the retard roller 52 and the torque limiter 55 are then attached to the second holder 114.

As shown in FIGS. 18, 19, and 20, when attaching the detachable unit 90 to the base guide 62, the detachable unit 90 is accommodated in the accommodating portion 70. In addition, when an external force F is applied to the detachable unit 90, the dowel 119 and the dowel 128 push the peak portion 174 in the +X direction from a state of being in contact with the end portion of the vertical wall portion 76 in the +Z direction and the peak portion 174. As a result, when the engaging portion 172 is rotated in the +X direction, the dowel 119 and the dowel 128 can move in the −Z direction. When the dowel 119 and the dowel 128 move in the −Z direction while being guided by the contact surface 77, the engaging portion 172 rotates in the −X direction. As a result, the engaging portion 172 is engaged with the dowel 119 and the dowel 128. In this manner, the detachable unit 90 is attached to the base guide 62.

Subsequently, in a state in which the knob 112 of the first holder 96 is pushed down, the feeding roller 46 is attached. Subsequently, when the roller cover 36 is attached to the door portion 17, a replacement work is completed.

Next, actions of the feeding unit 50 and the printer 10 will be described. There is a case where description of individual figure number is omitted for each configuration.

According to the feeding unit 50, when the downstream end of the paper P comes into contact with the second holder 114 or the guide plate 142 and the second holder 114 tries to be displaced in the +Z direction, the release lever 162 restricts the movement of the second holder 114 in the +Z direction.

Further, when the paper P thicker than the predetermined thickness enters the nip portion NP formed by the feeding roller 46 and the retard roller 52, the first holder 96 swings as the retard roller 52 moves in the −Z direction. As a result, there is a possibility that a force in the −Z direction is applied to the second holder 114. However, when the second holder 114 tries to be displaced in the −Z direction, at least one of the plurality of restricted portions 184 comes into contact with the restricting surface 186 of the second restricting portion 182, so that the movement of the second holder 114 in the −Z direction is restricted.

Due to the application, it is possible to suppress the position of the second holder 114 from shifting in the +Z direction or the −Z direction.

According to the feeding unit 50, when the engaging portions 172 are engaged with the dowel 119 and the dowel 128 at both end portions of the second holder 114 in the Y direction, the movement of the second holder 114 in the +Z direction is restricted. As a result, as compared with a configuration in which only one spot of the second holder 114 in the Y direction is restricted, it is difficult for an unnecessary moment to be applied to the second holder 114 when restricting the movement of the second holder 114, so that a change in the posture of the second holder 114 can be suppressed.

According to the feeding unit 50, as compared with a configuration in which the first restricting portion slides, the movement range of the release lever 162 can be reduced, so that the feeding unit 50 can be made smaller.

According to the feeding unit 50, the operating portion 164 is included, so that it is easier to perform an operation when the release lever 162 is swung.

According to the feeding unit 50, when the first inclined surface 176 comes into contact with the dowel 119 and the dowel 128, a pressing force including a component in the −Z direction is applied to the dowel 119 and the dowel 128. As a result, it is easier to hold the second holder 114 in the accommodating portion 70.

Further, when the second inclined surface 178 comes into contact with the dowel 119 and the dowel 128, a pressing force including a component in the +Z direction is applied to the dowel 119 and the dowel 128. As a result, it is easier to remove the second holder 114 from the accommodating portion 70.

According to the feeding unit 50, since the dowel 119 and the dowel 128 are sandwiched between the engaging portion 172 and the vertical wall portion 76, the dowel 119 and the dowel 128 are difficult to move, so that it is possible to suppress the dowel 119 and the dowel 128 from being misaligned in the X direction when the engaging portion 172 is engaged with the dowel 119 and the dowel 128.

According to the feeding unit 50, the retard roller 52 approaches the feeding roller 46 by the pressing force applied to the first holder 96 from the first pressing portion 80. As a result, even when relatively thick paper P enters the nip portion NP between the feeding roller 46 and the retard roller 52, the paper P can be easily handled by the retard roller 52.

According to the feeding unit 50, the position of the guide plate 142 can be adjusted with respect to the second holder 114 in a state in which the second holder 114 is accommodated in the accommodating portion 70. As a result, it is easier to adjust the interval d formed between the outer peripheral surface 48A of the feeding roller 46 and the guide plate 142.

According to the feeding unit 50, since the handling portion 150 is provided integrally with the guide plate 142, the handling portion 150 and the guide plate 142 are suppressed from being misaligned, as compared to a configuration in which the handling portion 150 is provided separately from the guide plate 142.

Here, since the size of the frontage 49 is adjusted by changing the position of the guide plate 142 with respect to the feeding roller 46, the number of paper P supplied to the feeding roller 46 through the frontage 49 can be limited within a predetermined number of sheets.

Furthermore, when the size of the frontage 49 is adjusted, the handling portion 150 is integrally provided with the guide plate 142. Therefore, not only the position of the guide plate 142 with respect to the feeding roller 46 but also the position of the handling portion 150 with respect to the feeding roller 46 can be adjusted. That is, the interval d between the feeding roller 46 and the handling portion 150 is also adjusted according to the adjustment of the size of the frontage 49. As a result, a predetermined load is applied to the paper P sandwiched between the feeding roller 46 and the handling portion 150, so that it is possible to suppress the deterioration of the action of handling the paper P by the handling portion 150.

According to the feeding unit 50, in the paper P fed toward the feeding roller 46, the first pad 152 in the −Y direction comes into contact with one side of the center in the Y direction, and the first pad 152 in the +Y direction comes into contact with the other side. As a result, it is possible to suppress the paper P from skewing in the +A direction as compared with a configuration in which the handling portion 150 comes into contact with only one portion of the paper P.

According to the feeding unit 50, since the feeding roller 46 and the handling portion 150 do not come into contact with the same position of the paper P in the Y direction, it is possible to suppress a part of the paper P from being more easily worn as compared with other parts.

According to the feeding unit 50, the handling portion 150 is disposed to come into contact with even the paper PS having the smallest size, so that the paper P of all sizes that can be fed by the feeding unit 50 can be handled by the handling portion 150.

According to the feeding unit 50, the nip portion NP is formed between the feeding roller 46 and the retard roller 52. Therefore, the position of the paper P whose downstream end first comes into contact with the outer peripheral surface 48A and the position of the virtual point C are shifted in the circumferential direction of the outer peripheral surface 48A. As a result, since the directions of the tangent lines at the respective positions are different, the paper P that advances along with the rotation of the feeding roller 46 changes a traveling direction by coming into contact with the handling portion 150, thereby advancing toward the nip portion NP.

Here, the handling surface 152A of the handling portion 150 extends along the reference line M. Therefore, as compared with a configuration in which the handling surface 152A along a direction different from the direction of the reference line M, the chance of contact of the handling portion 150 with the paper P increases and the paper P is easily guided to the nip portion NP. As a result, the handling portion 150 can enhance the effect of handling the paper P advancing toward the nip portion NP.

According to the feeding unit 50, the retard roller 52 can be replaced by removing the holder portion 94 from the accommodating portion 70.

According to the feeding unit 50, the retard roller 52 and the guide plate 142 are provided in the holder portion 94. Therefore, as compared with a configuration in which the guide plate 142 is provided on a member different from the holder portion 94, the positional accuracy of the guide plate 142 with respect to the retard roller 52 can be improved.

Based on the same principle as a cantilever beam, the paper P to be fed is easily hung downward in the Z direction as the distance from the center in the Y direction increases.

According to the feeding unit 50, the outer handling surface 168A positioned outside in the Y direction is positioned above the handling surface 152A in the Z direction. As a result, even when both the end portions of the paper P in the Y direction are hung down, both the end portions of the paper P are lifted upward and handled by the outer handling surface 168A, so that both the end portions of the paper P in the Y direction can be easily handled.

According to the feeding unit 50, when a plurality of outer handling surfaces 168A are included, the chance of contact between the paper P and the outer handling portion 167 increases, so that the handling performance of the paper P can be enhanced by the outer handling portion 167.

According to the printer 10, it is possible to obtain the same actions and effects as any one of the feeding units 50 described above.

Second Embodiment

A feeding unit 190 of a second embodiment will be specifically described below. The same reference numerals are given to the same configurations as in the printer 10 and the feeding unit 50 of the first embodiment, and the description thereof will be omitted.

Figure 21:
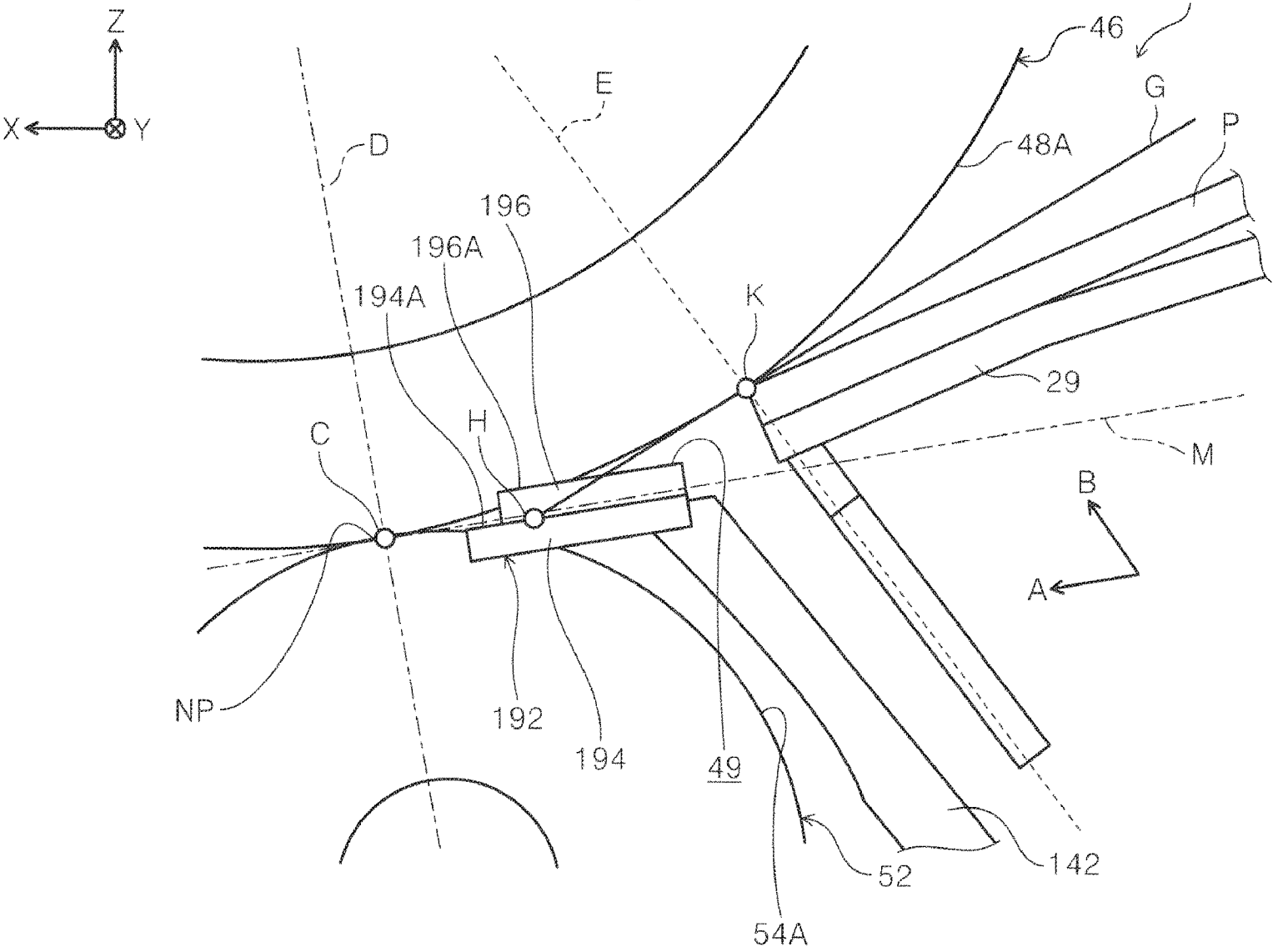
FIG. 21 is a schematic diagram showing a paper path from a lifter to a nip portion of a feeding unit according to a second embodiment.

As shown in FIG. 21, the feeding unit 190 is an example of a feeding device that feeds the paper P. Further, the feeding unit 190 is provided with a handling portion 192 instead of the handling portion 150 in the feeding unit 50 (FIG. 4). The configuration other than the handling portion 192 is the same as the configuration in the feeding unit 50.

The handling portion 192 has handling surfaces 194A and 196A that are aligned in the +A direction and come into contact with the paper P. Specifically, the handling portion 192 has a multi-layer structure in which a lower pad 194 and an upper pad 196 are laminated and adhered in the B direction.

The lower pad 194 is a rectangular board having a dimension in the Y direction larger than a dimension in the +A direction. The lower pad 194 is, as an example, made of a resin member. The lower pad 194 may be made of an elastic member such as rubber. The lower pad 194 is adhered to the flange portion 147 (FIG. 10). The handling surface 194A, which is a surface of the lower pad 194 in the +B direction, comes into contact with the paper P. The handling surface 194A is an example of a plurality of handling surfaces. A frictional coefficient μ3 in the contact of the handling surface 194A with the paper P is, as an example, set to the same value as the frictional coefficient μ1.

The upper pad 196 is a rectangular board having a dimension in the Y direction larger than a dimension in the +A direction. The upper pad 196 has the same configuration as the lower pad 194 other than the size.

The dimension of the upper pad 196 in the Y direction is the same as the dimension of the lower pad 194 in the Y direction. The dimension of the upper pad 196 in the +A direction is smaller than the dimension of the lower pad 194 in the +A direction. The upper pad 196 is laminated and adhered to the lower pad 194 from the +B direction in a state in which the end surface of the upper pad 196 in the −A direction and the end surface of the lower pad 194 in the −A direction are aligned.

The handling surface 196A, which is a surface of the upper pad 196 in the +B direction, comes into contact with the paper P. The handling surface 196A is an example of a plurality of handling surfaces. A frictional coefficient μ4 in the contact of the handling surface 196A with the paper P is, as an example, set to the same value as the frictional coefficient μ1.

In this manner, the handling surface 194A is positioned in the −B direction and the +A direction with respect to the handling surface 196A.

Here, according to the feeding unit 190, the handling surface 194A and the handling surface 196A are included. Therefore, as compared with a configuration of one handling surface, the chance of contact between the paper P and the handling portion 192 increases, so that the handling performance of the paper P can be enhanced by the handling portion 192.

As an example, when four sheets of paper P are fed, first, the paper P is separated from four sheets to three sheets in the upper pad 196. Subsequently, the paper P is separated from three sheets to two sheets in the lower pad 194. Finally, the paper P is separated from two sheets to one sheet at the nip portion NP. By doing so, front handling is performed upstream in the +A direction with respect to the nip portion NP.

MODIFICATION EXAMPLE

The feeding units 50 and 190 according to the first and second embodiments of the present disclosure are based on the configuration described above, but it is apparent that changes, omission, and the like of partial configurations are possible without departing from the gist of the present disclosure.

Figure 22:
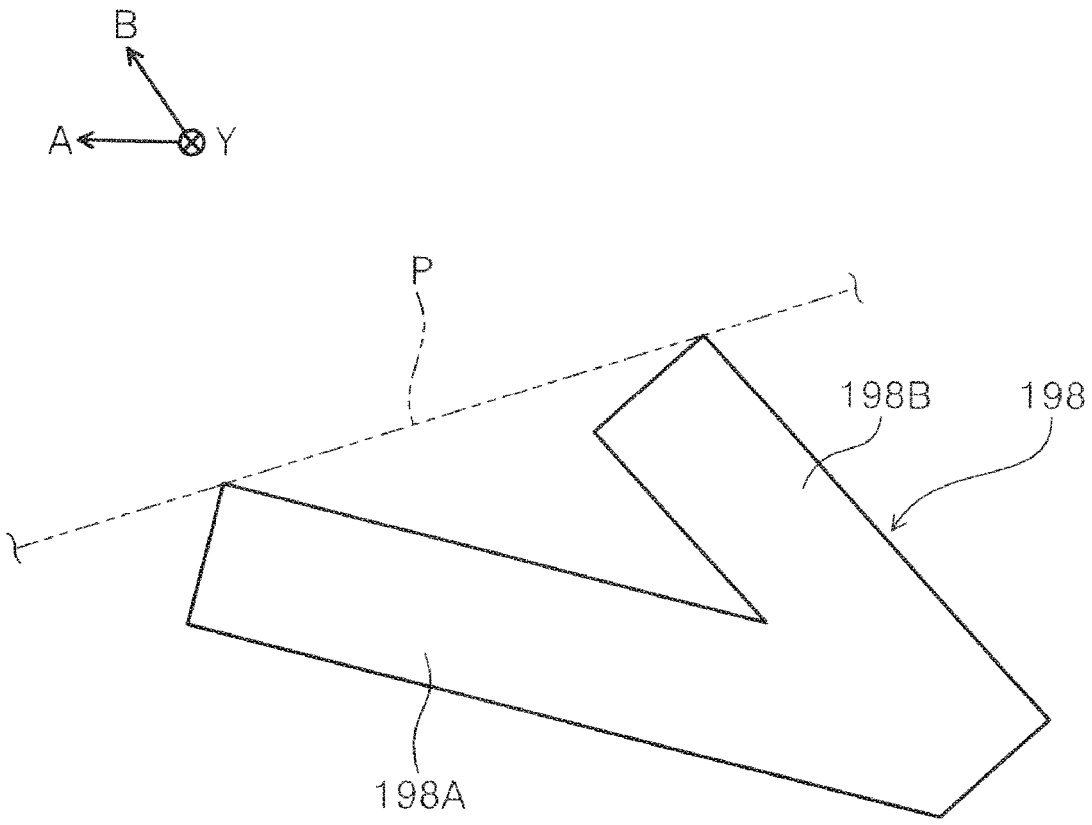
FIG. 22 is a schematic diagram showing a state in which a plurality of handling portions are provided at different angles as a modification example of the feeding units according to the first embodiment and the second embodiment.

As shown in FIG. 22, a handling portion 198 according to a modified example may be used.

The handling portion 198 has a first plate portion 198A and a second plate portion 198B arranged in the +A direction, which are integrated. The first plate portion 198A and the second plate portion 198B have different angles in the extension direction with respect to the +A direction when viewed from the Y direction. The corners of the second plate portion 198B are positioned in the −A and +B directions with respect to the corners of the first plate portion 198A. In this way, by providing a plurality of handling portions arranged in the +A direction, the chances of contact between the paper P and the handling portions may be increased.

OTHER MODIFICATION EXAMPLES

In the feeding unit 50, either the engaging portion 172 engaged with the dowel 119 in the −Y direction or the engaging portion 172 engaged with the dowel 128 in the +Y direction may not be provided. The release lever 162 is not limited to swinging, and may slide in one direction. The release lever 162 may not have the operating portion 164. The second inclined surface 178 may be omitted in the engaging portion 172. The vertical wall portion 76 may be omitted. The first pressing portion 80 may be omitted.

A configuration in which a plurality of restricted portions 184 are provided in each of the Y direction and the +A direction indicates a configuration in which there are a plurality of restricted portions 184 when viewed from the +A direction or the Y direction. In other words, the number of restricted portions 184 is not limited to four, and may be three or five or more.

In the feeding unit 50, each of the number of handling portions 150, 192, and 198 and the outer handling portion 167 is not limited to two in the Y direction, and may be one or three or more. Further, the width in the Y direction, the length in the +A direction, and the thickness in the +B direction of the handling portions 150, 192, and 198 and the outer handling portion 167 may have different sizes from the sizes in the embodiments. The outer handling portion 167 may not be provided.

The size of the interval between the handling portions 150, 192, and 198 in the Y direction may be larger than the size of the paper PS in the Y direction. The handling surface 152A may not extend along the reference line M.

The guide plate 142 may be provided on a member different from the second holder 114.

Parts of the handling portions 150, 192, and 198 may be positioned inside the outer peripheral surface 48A of the feeding roller 46 in the Y direction when viewed from the +A direction.

What is claimed is:

1. A feeding device comprising:

a medium stacking portion that stacks a medium;

an elevating portion that is configured to displace the medium of the medium stacking portion in a stacking direction;

a rotating member that feeds the medium lifted by the elevating portion in a feeding direction;

a guide portion that guides a downstream end in the feeding direction of the medium lifted by the elevating portion toward the rotating member; and a handling portion that handles the medium toward the rotating member, wherein the guide portion forms a frontage through which the medium is configured to pass between the guide portion and an outer peripheral surface of the rotating member, and is provided such that a size of the frontage is configured to be adjusted, and the handling portion is provided integrally with the guide portion.

2. The feeding device according to claim 1, wherein a plurality of the handling portions are provided at an interval in a width direction of the medium which intersects the feeding direction, and when viewed from the feeding direction, one handling portion of the handling portions is positioned on one side of the rotating member with respect to a center of the width direction, and the other handling portion is positioned on the other side of the rotating member with respect to the center of the width direction.

3. The feeding device according to claim 2, wherein when viewed from the feeding direction, the plurality of handling portions are positioned outside the rotating member in the width direction with respect to the outer peripheral surface.

4. The feeding device according to claim 2, wherein a size of the interval between the one handling portion and the other handling portion in the width direction is smaller than a size of the medium having a smallest size in the width direction among the fed media.

5. The feeding device according to claim 1, further comprising:

a retard roller that forms a nip portion by coming into contact with the outer peripheral surface, wherein using a tangent line of the outer peripheral surface, which passes through a virtual point at a center of the nip portion in the feeding direction as a reference line, a handling surface of the handling portion which comes into contact with the medium extends along the reference line.

6. The feeding device according to claim 5, further comprising:

a holder portion that rotatably holds the retard roller; and an accommodating portion that accommodates the holder portion, wherein the holder portion is detachably provided in the accommodating portion.

7. The feeding device according to claim 6, wherein the guide portion is provided in the holder portion.

8. The feeding device according to claim 1, further comprising:

an outer handling portion that handles the medium toward the rotating member on an outside with respect to the handling portion in a width direction of the medium, which intersects the feeding direction, wherein an outer handling surface of the outer handling portion which comes into contact with the medium is positioned above a handling surface of the handling portion which comes into contact with the medium in a vertical direction.

9. The feeding device according to claim 1, wherein the handling portion has a plurality of handling surfaces aligned in the feeding direction and coming into contact with the medium.

10. A recording device comprising:

the feeding device according to claim 1; and a recording portion that records on the medium fed from the feeding device.

* * * * *